US008650717B2

(12) United States Patent
Hao et al.

(10) Patent No.: US 8,650,717 B2
(45) Date of Patent: Feb. 18, 2014

(54) PROCESSING LINE OF BAST FIBER

(75) Inventors: Xinmin Hao, Beijing (CN); Guojun Zhang, Ningbo (CN); Mingzhai Gao, Yunnan (CN); Meijun Qiu, Yunnan (CN); Chao Gao, Yunnan (CN); Minzhu Ning, Yunnan (CN)

(73) Assignees: China-Hemp Industrial Investment Holdings Co., Ltd., Yunnan (CN); The Quartermaster Research Institute of the General Logistics Department of the CPLA, Beijing (CN); Ningbo Yak Technology Industrial Co., Ltd., Ningbo, Zhejiang (CN)

( * ) Notice: Subject to any disclaimer, the term of this patent is extended or adjusted under 35 U.S.C. 154(b) by 0 days.

(21) Appl. No.: 13/574,759

(22) PCT Filed: Jan. 21, 2011

(86) PCT No.: PCT/CN2011/000101

§ 371 (c)(1),
(2), (4) Date: Sep. 5, 2012

(87) PCT Pub. No.: WO2011/088750

PCT Pub. Date: Jul. 28, 2011

(65) Prior Publication Data

US 2012/0324677 A1 Dec. 27, 2012

(30) Foreign Application Priority Data

Jan. 22, 2010 (CN) ..... 2010 1 01001111

(51) Int. Cl.
*D01G 1/00* (2006.01)

(52) U.S. Cl.
USPC ..... 19/0.35; 19/7

(58) Field of Classification Search
USPC ..... 19/0.35, 5 A, 5 R, 7, 10
See application file for complete search history.

(56) References Cited

U.S. PATENT DOCUMENTS

| | | | | |
|---|---|---|---|---|
| 2,738,271 | A * | 3/1956 | Fabian | 162/60 |
| 5,970,582 | A * | 10/1999 | Stover | 19/5 R |
| 6,357,083 | B1 * | 3/2002 | Stratton et al. | 19/5 R |
| 7,624,478 | B2 * | 12/2009 | Liu et al. | 19/7 |
| 7,892,397 | B2 * | 2/2011 | Luo et al. | 162/29 |
| 8,256,066 | B2 * | 9/2012 | Bubnov et al. | 19/7 |
| 8,268,127 | B2 * | 9/2012 | Liu et al. | 162/98 |
| 2011/0099766 | A1 * | 5/2011 | Bubnov et al. | 19/7 |

FOREIGN PATENT DOCUMENTS

| | | | |
|---|---|---|---|
| CN | 85104665 | A | 7/1986 |
| CN | 85105350 | A | 1/1987 |
| CN | 86210424 | U | 12/1987 |
| CN | 1113971 | A | 12/1995 |

(Continued)

OTHER PUBLICATIONS

ISA China, International Search Report of PCT/CN2011/000101, Apr. 28, 2011, WIPO, 8 pages.

*Primary Examiner* — Shaun R Hurley

(74) *Attorney, Agent, or Firm* — Alleman Hall McCoy Russell & Tuttle LLP

(57) ABSTRACT

A processing line of bast fiber is provided. The processing line is comprised of various devices for carding, cutting, degumming, high temperature washing, separating and water washing, softening, drying, batching and applying oil, permeating and reconditioning, stretching-breaking carding, and combing and sorting. The processing line of bast fiber can improve production efficiency, and improve the yield of long hemp fibers. Moreover, the produced fiber has stable quality and is convenient for post-processing.

10 Claims, 12 Drawing Sheets

(56) References Cited

FOREIGN PATENT DOCUMENTS

| | | | |
|---|---|---|---|
| CN | 101245492 | A | 8/2008 |
| CN | 101451274 | A | 6/2009 |
| CN | 101463511 | A | 6/2009 |
| CN | 101824658 | A | 9/2010 |
| CN | 101824671 | A | 9/2010 |
| CN | 101824676 | A | 9/2010 |
| CN | 101824683 | A | 9/2010 |
| CN | 101838894 | A | 9/2010 |
| CN | 101851787 | A | 10/2010 |
| CN | 101851789 | A | 10/2010 |
| CN | 101851790 | A | 10/2010 |

* cited by examiner

PROCESSING LINE OF BAST FIBER

CROSS-REFERENCE TO RELATED APPLICATIONS

The present application is the U.S. National Phase of International PCT Application Serial No. PCT/CN2011/000101, filed Jan. 21, 2011, which claims priority to Chinese Application No. 2010101001111, filed Jan. 22, 2010, the disclosures of each of which are hereby incorporated by reference in their entirety for all purposes.

FIELD OF THE INVENTION

The present disclosure relates to equipment for processing bast fiber, and in particular to a processing line for bast fiber.

BACKGROUND OF THE INVENTION

China is not only a large exporter of chemical fiber, cotton products, textiles, and clothing, but is also a main producer of textiles. In 2000, the output of the synthetic fiber had reached 10 million tons, which comprises 70% of total amount of fiber in China, much higher than 60% in the worldwide, causing the ratio of natural and chemical fibers to go out of balance. As petroleum, coal and natural gas, which are non-renewable resources, are used as raw materials to produce synthetic fiber, and they will be exhausted in the future, renewable, recyclable, and green environmental friendly resources have attracted increasing attention. Due to reforms and more open policy in China, cotton supply has been in a state of shortage for more than 20 years. The history of silk in China began in the Jiangsu and Zhejiang regions, however, because of the extreme shortage of the land resources and low added value of the textile, the development of the textile has suffered from a lot of restrictions, and thus, during the past decade, the total output has been decreasing year to year. Wool is favored by people, but the annual output and quality of Chinese wool doe not meet domestic demand, so in recent years, a great amount of raw wool, scoured wool, wool top, and wool yarn have been imported every year.

In natural fibers, the development of hemp fiber has the broadest prospects for mass adoption, considering that ramie, flax, jute, and cannabis can be used for textiles, and other hemps (such as sisal, abaca, etc.) fibers can be mostly used for hemp rope, sacks and other industrially packaging materials.

At present, the planting area of flax fiber crops in China is about 3 million mus (1 mus=6000/9 $m^2$) which has surpassed that of France, Britain, and Russia, however, the average output and fiber percentages in China are low, which is about 50% lower than in developed countries. Because the technology for processing flax in China is antiquated, the fiber percentage (long hemp) is only 11%-13%, and strength is not high, moreover the end breakage rate is high, therefore, it is difficult to produce spun yarn. Thus, it is urgent to develop a new process and a new technology to solve the above problems.

Generally, the perennial ramie planting area in China is 1.50-3.00 million mus and the output of fiber is about 0.25 million tons which accounts for more than 90% of global output. However, the present production technology and production equipment, which are the technological the equivalent 1950s and 1960s industry, is antiquated, characterized by low productivity, a harsh production environment, and serious environment contamination, due to the large volume of sewage produced in the process, which seriously influences the development of ramie processing.

Cannabis, which has a fiber output per mu higher than ramie and flax, is a kind of traditionally planted hemp crops in China, and cannabis fiber has excellent moisture absorption and permeation, natural antimicrobial activity, pliability and comfort, anti-ultraviolet properties, sound absorption, odor adsorption, and other functions. Cannabis textile has a unique style, and therefore, it is very popular in European and American clothing markets. Nevertheless, the current main bottleneck and restricting factors in cannabis fiber processing are as follows: (1) Cannabis planting: the different uses of cannabis fiber have different requirements for planting and harvesting; (2) Cannabis bast fiber producing: namely, the separation of cannabis skin from cannabis stem. The separation of skin from stem in Chinese traditional processing belongs to a labor intensive processing, that is to say, hand stripping process, which greatly limits processing efficiency and increases labor costs; (3) Cannabis bast fiber degumming: compared with flax and ramie, cannabis has higher contents of lignin, hemicellulose, pectin and other non-cellulose ingredients, and the distribution and ease of degumming of each ingredient in the cannabis bast are different from other hemp basts. Further, the individual fiber length of cannabis is shorter, thus, it is difficult to control the degumming level, which is a technical problem that has not been solved for many years in the world; (4) The traditional process for processing cannabis fiber is time consuming, characterized by old production equipments, little mechanization and automation, intensive, low productivity labor, old processing technology, large energy consumption, the production of a large amount of sewage which cause serious environmental problem, and low fiber availability and quality which make it difficult to produce a high grade product. All of these are the problems that need to be solved urgently.

SUMMARY OF THE INVENTION

In view of the above problems, an object of the present disclosure is to improve the equipment and provide a new processing line of bast fiber.

To this end, the present disclosure employs the following technical solutions: a processing line of bast fiber including various devices for carding, cutting, degumming, high temperature washing, separating and water washing, softening, drying, applying hemp-softening oil, permeating and reconditioning, stretch-breaking and carding, and combing and sorting, which is wherein:

The cutting device includes a door-shaped rack with a motor disposed on one side, said motor drives a group of worm and worm wheel mechanism through a driving mechanism, the worm wheel in said worm and worm wheel mechanism is coaxially connected to a crank disc of a crank mechanism, the crank disc is eccentrically attached with a connecting rod, the other end of the connecting rod is connected to a cutter which crosses two vertical beams of the rack, and is movably supported on the horizontal beam of the rack, the cutter and the horizontal beam have a correspondingly arranged guiding block and a guiding groove in inclined movement, two sides of the rack below the cutter are provided with a feeding support plate and a discharging support plate respectively, in which a cutter resting groove facing the cutter is connected between the feeding support plate and the discharging support plate, and at least one of the feeding support plate and the discharging support plate is designed with a scale for measuring fiber length.

The degumming device includes a mechanical degumming device, a biological degumming device, and a high temperature digesting and degumming device which is also used for high temperature washing.

The separating and water washing device includes a rack on which an endless holed conveying belt is disposed, and above the belt, a feeding roller, a compression roller, a plurality of beaters spaced apart and a separating roller are disposed sequentially, wherein a bundle collecting plate is disposed between the beater and the separating roller, and a high pressure nozzle is disposed above (not directly) the beater and separating roller, a water collection tank is disposed below the belt, and an arranging mechanism is disposed at the end of the belt.

The stretch-breaking and carding device includes a sequentially disposed stretch-breaking mechanism, a bundle collecting device, a gill box and a strip forming can, in which the stretch-breaking mechanism includes a hemp-feeding plate disposed at the input end of the rack and a feeding roller driven by the motor, several groups of stretching units are disposed at the front of the output end of the feeding roller, each stretching unit is provided with two synchronously rotational support rollers, and the rotating speed of the support roller in the front stretching unit is greater than that of the support roller in the rear stretching unit. A pressurizing roller driven by friction of the two support rollers is disposed on the top of each of the two support roller, wherein a pressurizing device connected to the rack is disposed in the central axis of the pressurizing roller, the two support rollers are connected to a driving mechanism at one end and supported on a moving device at the bottom.

The combing and sorting device includes a feeding mechanism, a nipping plate mechanism, a carding mechanism, a pulling and separating mechanism, a strip producing mechanism, and a cleaning mechanism, wherein the feeding mechanism includes a feeding rack, a strip guiding plate, a strip guiding roller, a hemp holding plate, a compression roller, a feeding roller and a feeding box; the carding mechanism includes a circular comb and a top comb, in which the needles of the circular comb are arranged in the circumference range between 0-270°, and the density of the needle is gradually increased and the fineness of the needle is gradually reduced along the rotation direction; the pulling and separating mechanism includes a pulling carriage, a pulling roller, a pulling leather plate and a breaking cutter, wherein the pulling carriage is mounted on the adjusting bracket, the adjusting bracket is disposed with a barre at one side, and designed with an arc sliding chute inserted with a bolt which is fixed onto the rack, and the adjusting bracket can slide along the arc sliding chute by releasing the bolt and moving the barre; the strip producing mechanism includes at least two pairs of crimping rollers which are disposed with a horizontal groove in its surface; a breakage automatic stop device and a hemp-twisting automatic stop device are disposed in the carding mechanism and the pulling and separating mechanism, and a full package automatic stop device is disposed in the packaging mechanism.

The mechanical degumming device includes a feeding area, a mechanical rubbing area, a trash cleanup area, a discharging area and a trash cleanup device, wherein the mechanical rubbing area includes upper and lower rows of the rollers set in pairs and is driven by a drive motor, and the upper row rollers are disposed with a pressure control device respectively on the top of the two ends thereof, and the trash cleanup area includes a conveyor belt arranged with holes wherein at least two upper pat rollers are disposed above the upper band of the conveyor belt, and at least one lower pat rollers located between two upper pat rollers in a transmit direction are disposed between the upper band and lower band of the conveyor belt.

The biological degumming device includes an inoculation system, a bio-fermentation system, and a sterilizing system, said inoculation system and said bio-fermentation system both include a lidded main cylinder, a hot water bucket and a main pump, wherein the main cylinder's liquid outlet is connected to the main pump's liquid inlet, while the main cylinder's liquid inlet is connected to the main pump's liquid outlet through a compression air pump; the main cylinder's inner wall is disposed with a coiled pipe having two ends respectively connected to the water inlet and water outlet of the hot water bucket via pipelines, in which one of the pipelines is disposed with a water pump; said sterilizing system includes a barrel-shaped lidded sterilizing main cylinder, wherein a liquid outlet connected to the main pump is disposed at the lower portion of the main cylinder, and the main pump's water outlet is connected to a heat-exchanging device having a water outlet connected to a liquid inlet disposed at the lower part of the sterilizing main cylinder, and a filter plate with holes is disposed inside the lower part of the sterilizing main cylinder, and a secondary cylinder is further disposed outside the sterilizing main cylinder; a yarn hanging device is disposed inside the main cylinders of said inoculation system, said bio-fermentation system, and said sterilizing system respectively.

Said high temperature digesting and degumming device includes one barrel-shaped lidded main cylinder with a yarn hanging device disposed inside and a main pump disposed outside, wherein the main pump's water inlet is connected to the main cylinder's water outlet while the main pump's water outlet is connected to a heat-exchanging device, and the main cylinder is connected to a secondary cylinder from outside through a pipeline with a valve, wherein the secondary cylinder provides chemical additives.

Said yarn hanging device is a plurality of parallel or serial yarn hanging racks each including a hollow post, wherein the hollow post is closed at the top and disposed with a hanger, and the left and right sides of the hollow post are separately symmetrically designed with a plurality of layers of the hollow beams communicated with the hollow post from up to down, the outer end of each hollow beam on each side is connected to form an integrated unit through the same support post, and a plurality of hanging rods communicated with the hollow beams are disposed at intervals on the two hollow beams of the first layer at the top, wherein the upper half of each hanging rod is disposed with a plurality of holes, and a plurality of spraying rods are disposed at intervals on each hollow beam of the second layer and the below layers, wherein the spraying rod communicates with the hollow beam and is located correspondingly to a respective hanging rod, in which the spraying rod is designed with a plurality of spraying holes on the side thereof, and said hollow post and the support post are connected at the bottoms to a creel chassis designed with meshes, wherein the hollow post is disposed with a liquid inlet on the end while the two support posts are disposed with a surrounding outer cylinder which is two-to-two symmetrically hinged to four creel baffles of two support posts, and the creel baffle is suffused with water outlets; when a number of the yarn hanging racks with a cover body disposed between each of them are in series, the top of the hollow post of the topmost yarn hanging rack is closed, while the top of the hollow post of each yarn hanging racks below the topmost one is open and communicates with each other and the hollow post of the lowest yarn hanging rack is provided with a liquid inlet at the bottom; when a number of the yarn hanging racks are positioned in parallel, the liquid inlets at the bottom of the hollow post of each lowermost yarn hanging rack are connected in parallel so as to circulate via a main pump, and the hollow posts of each yarn hanging rack are all disposed with a hanger at the top.

Said washing and softening device includes a rack onto which a meshed belt is disposed, and a feeding roller, a separating roller, and a squeezing roller are disposed sequentially from the conveying starting end to the terminal end of the belt, wherein the feeding roller and the carding roller disposed with a spray water pipe at the top are disposed above the belt, and said squeezing roller is disposed on the upper and lower surfaces of the belt symmetrically; a hot water tank for immersing the belt, disposed with a heating device inside, is provided below the belt, wherein the hot water tank protected in a shell is connected with a water circulation processing device at the lower end of the rack; an arranging mechanism is disposed at the terminal end of the belt.

Said hemp-softening oil applying device includes a rack disposed with at least two groups of squeezing-rubbing units in addition to a feeding unit, wherein neighboring squeezing-rubbing units are connected by a backing plate, and each group of squeezing-rubbing units includes several pairs of engaged upper and lower rollers which are driven by a variable frequency motor, and the roller located in the upper part is pressurized by a pressurizing device, and high pressure fuel injection pipes are disposed above the inlet of the first pair of rollers of the first group of squeezing-rubbing units and above and below the backing plate respectively, and an oil-impurity separation device is located below the lower roller and is disposed with an oil recovery device below it.

Said permeating and reconditioning device includes a closed chamber filled with water, within which a hemp fiber arranging device is disposed, wherein the inner top of the chamber is a slope, and a heating device being supplied with water, an injection valve, a drain valve, a level control device, a water temperature control device, and a barometer for measuring air pressure within the chamber, a vacuum pump for controlling air pressure within the chamber, a safety valve and an exhaust valve are disposed on the chamber where a sealing door is disposed.

In said separating and water washing device, an arch steel bracket plate is disposed at the belt bottom corresponding to the impacting point of the beater, wherein the midst and two sides of the bracket plate are disposed within the rack slides of two sides, in which the front and rear ends along the belt movement direction are moveable ends; said beater consists of three planet rollers covered with elastic rubber and spaced apart 120°.

In said stretch-breaking and carding device, said shift device includes a support plate, by which two support rollers are supported, wherein with a rack bar, the bottom of the support plate is connected to a gear which has a crank and is supported on the rack, and the other ends of two support rollers are respectively connected to a universal joint transmission shaft with the other end connected to an output gear of a driving mechanism; in said stretch-breaking and carding device, said gill box is a push-bar gill bar structure and includes a front roller/leather roller, a middle roller/leather roller, and a rear roller/leather roller, wherein a hollow side disc having grooves is disposed between the front roller/leather roller and the middle roller/leather roller, and a needle plate is set in the grooves, and the side disc is disposed with a cam at the centre, thus under the guiding by the cam, the needle plate slides along the cross section of the cam; in said combing and sorting device, the circular comb has two forms, i.e., full teeth-bar-type needle strip and a teeth-bar-type needle strip combined with a gill bar-type needle strip, so during the multiple combing processes, the first combing process employs the full teeth-bar-type needle strip, and the following processes of each combing employ the form of the teeth-bar-type needle strip combined with the gill bar-type needle strip, and said top comb has two types, i.e., a single row needle strip type and a multi-row needle strip type, so during the multiple combing processes, the first combing process employs the form of the single row needle strip type, and the following processes of each combing employ the form of the multi-row needle strip type.

The present disclosure has the following advantages by adopting the above technical solutions: 1) by means of the upper and lower rows of the rollers set in pairs, the bast fiber can be squeezed and rubbed repeatedly and degummed, so the use of pollution-free physical and mechanical degumming can reduce the biochemistry degumming difficulty and pressure, the processing time and the pollutant discharge, and improve the fiber separation index and the biochemistry degumming uniformity, at the same time, by-products from the mechanical degumming can also be collected to achieve the purpose of comprehensive utilization. In trials, mechanical degumming before digesting not only removed 5%-8% chunks of gum, but also removed impurities resulting from the uncompleted separation of hemp skin and stem. Using this method, the bast separation index will increase by 10~20%; 2) the biological degumming device of the present disclosure contains three groups of independent systems, wherein each system includes a main cylinder designed with a yarn hanging rack inside, and the bast fiber hung on the yarn hanging rack is treated by means of a treatment solution which is prepared within the main cylinder, therefore, the solution containing biological strains can be used many times, which on the one hand effectively reduces cost and improves the economic benefit, and on the other hand makes the sewage easy to collect and process, thus reducing environmental pollution greatly. The coiled pipe is provided within the main cylinder, wherein the water in the coiled pipe is provided by the hot water bucket, therefore, the treatment solution in the main cylinder is heated by the heat released by the hot water in the coiled pipe, consequently, the heating temperature is stable and has a high controllability. After degumming, putting a certain scouring medium and lye into the main cylinder of the sterilizing system, improving the temperature above 100° C., and keeping this heat for 10-30 min can achieve inactivating effects on the bacteria, and also realize the first washing of the residual gum, so as to ensure that the bacteria are prevented from being lost to the external environment and reduce the burden of post treatment; 3) the high-temperature digesting device is disposed with a main cylinder having a main cylinder and a heating device disposed outside, wherein the treatment solution in the main cylinder can be circulated between the main pump and the main cylinder, at the same time, the circulating treatment solution can also be heated by the heating device, therefore, the temperature of treatment solution can be maintained within the setting range. The secondary cylinder, which can be used to supplement chemical additives or a bleach agent to the main cylinder, is disposed on the main cylinder from outside, thus, it guarantees the requirements of the process within the main cylinder. The main pump is disposed outside the main cylinder within which the yarn hanging device is positioned, wherein the bast fiber is hung on the yarn hanging device, and thus the inventive device can achieve the purpose of spraying and circulating efficiently inside the cylinder, which makes the processing uniformity much higher than that of the traditional liquid circulation processing device; 4) the yarn hanging rack used in each device is disposed with the hollow post, wherein at least one layer of hollow beam is disposed on two sides of the hollow post, and the hanging rod with a plurality of holes designed on the upper half part is disposed at the top of the hollow beam, and the spraying rods with holes designed on the side face are disposed below each layer of hollow beams. Consequently, when the main pump starts working, the treatment solution can be sprayed from each hanging rod hole to perform the spray processing on the bast fibers all around, and the bast fibers can be processed uniformly and thoroughly. A meshed chassis is disposed on the hollow post bottom, thus it can make the treatment solution flow into the yarn hanging device, and prevent the scattered fiber from falling into the cylinder containing the treatment solution, making the treatment solution circulating smoothly. A plurality of yarn hanging racks may be disposed in series to become one communicated body to circulate the treatment solution conveniently. The hanger is disposed on the top of the hollow post, as a consequence, the hanger may be moved into the treatment tank by a lifting equipment even if they are used in series, the moving is also very convenient. When two yarn hanging racks are in series, there is a cover body disposed between them, so when the yarn hanging racks are used in series, the cover body can be used to prevent the water from leaking out of the upper yarn hanging rack, so that the water leaked from the upper hanging rack can be discharged from the water outlet of the outer cylinder, therefore, it can make the treatment effects of different series locations of the upper and lower yarn hanging racks the same; 5) the separating and washing device of the present disclosure is disposed with multi-group of separating and washing units, wherein each group of separating and washing units is disposed with a plurality of spaced beaters and separating rollers, wherein by high pressure water washing, beater beating, gathering with the bundle collecting plate and carding with the separating roller, the hemp fiber is made to be more uniform, thus, the fiber separation index is better and the spinning property is improved greatly. As a consequence, it can save water about three times than that of conventional treatment; 6) the hemp-softening oil applying device of the present disclosure is variable in speed to perform squeezing and rubbing on the rollers, at the same time, applying hemp-softening oil and washing and softening further improves the softening effect of degummed hemp, and then the spinning property of hemp fiber is improved greatly; 7) the stretch-breaking and carding device of the present disclosure combines the functions of straightening, stretching, breaking, collecting and carding together, and as a result, produces hemp strips for spinning coarse yarn in one step which can shorten the process and reduce the cost, and only the high count yarn spinning process needs to perform carding; wherein through the controlling over the speed, the pressure and the interval of the stretch-breaking mechanism, the hemp fiber strip with different lengths can be obtained, thus the fiber length controllability is improved greatly; 8) the combing and sorting device of the present disclosure can be used to comb and separate the combed hemp strips and fallen objects to separate and extract the fiber with different length and fineness step by step, therefore a more uniform and straight fiber with specified length can be obtained, then the fiber can be used to spin directly after combing; 9) the present disclosure utilizes the rapid permeating and reconditioning device, the high speed gilling machine, the high speed comber and the auto-leveler machine, etc. to change the traditional hemp spinning process, raise the production efficiency and improve the long hemp yield, moreover, the produced hemp fiber quality becomes more stable and facilitates the subsequent process.

BEST EMBODIMENTS OF THE INVENTION

The present disclosure will be described in detail with reference to the drawings and example embodiments.

The basic processes of bast fiber comprises breaking hemp skin, sorting, cutting off roots and tops, then mechanically degumming with a mechanical degumming device; the hemp is basketed after the mechanical degumming and processed by the biological and/or high temperature digesting for degumming and the high temperature washing, and then manufactured into the degummed hemp by separating and washing, washing and softening, radio drying, and the degummed hemp is subjected to mechanical softening and reconditioning and is manufactured into the long hemp fiber strip by stretch-breaking carding, combing, drawing; and then the fallen hemp is subjected to carding and grading, then becomes the short hemp fiber.

In each of above processes, the mechanical degumming, biological degumming, high temperature digesting, high temperature washing, separating and washing, washing and softening, mechanical applying of hemp-softening oil, permeating and reconditioning, stretch-breaking carding, combing and carding and the other equipments are all improved compared with those in the prior art, and now they will be respectively described in detail.

1. Mechanical Degumming Device

Figure 1:
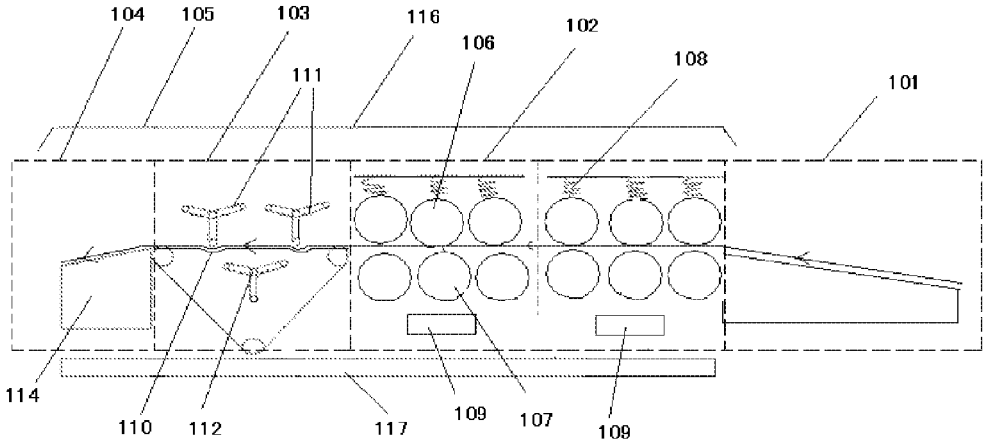
FIG. 1 shows a schematic front view of the mechanical degumming device in accordance with the present disclosure.
Figure 2:
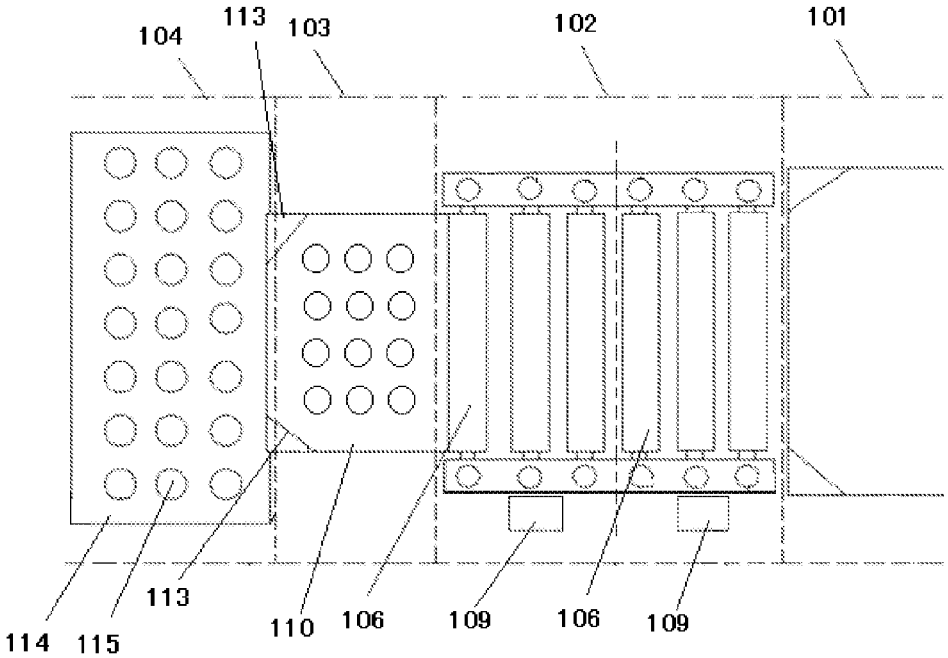
FIG. 2 shows a top view of FIG. 1.

As shown in FIGS. 1 and 2, the present disclosure includes a feeding area 101 connected to a mechanical rubbing area 102, wherein the mechanical rubbing area 102 is connected to a trash cleanup area 103, the trash cleanup area 103 is connected to a discharging area 104, and a trash cleanup devices 105 disposed on upper and lower parts of each area. The bast fiber which has been sorted into bundles during the previous process is unfolded and flatted in the feeding area 101 and then fed into the mechanical rubbing area 102. The mechanical rubbing area 102 includes upper and lower rows of the grooved rollers 106, 107 set in pairs, and the tops of the two ends of the upper row grooved rollers 106 are disposed with a pressure control device 108 respectively, wherein the space between the upper and lower grooved rollers 106, 107 can be adjusted in accordance with the desired pressure. One of the lower grooved rollers 107 may be rotated by a drive motor 109 through a belt, and the other upper and lower grooved rollers are driven by a gear, and also the upper and lower grooved rollers 106, 107 can be set into several groups, and each group is driven by the drive motor 109. During operation, the forward speed, backward speed, forward time and backward time of the upper and lower grooved rollers 106, 107 can be further adjusted by adjusting rotation direction, speed and time of the drive motor 109, so that the bast fiber is squeezed and rubbed back and forth in the mechanical rubbing area 102 to force the gum on the bast fiber to be broken and dropped. The pressure control device 108 may be an oil pressure device, an air pressure device or a spring device, and the present disclosure adopts the spring device which can be used to adjust the space between the upper and lower grooved rollers 106, 107 through adjusting the pressure applied on upper grooved roller 106 by an adjustable bolt when used.

The trash cleanup area 103 of the present disclosure includes a conveyor belt 110 arranged with via holes wherein at least two upper pat rollers 111 are disposed above the upper belt of the conveyor belt 110, and at least one lower pat roller 112 that is located between two upper pat rollers 111 in a transmit direction is disposed between the upper belt and lower belt of the conveyor belt 110. Upper and lower pat rollers 111, 112 may be adopted in different structure forms, for example, the present embodiment adopts the form of three rubber rollers combination spaced apart 120°. A limit structure 113 is disposed on two sides of the conveyor belt 110, so that the bast fiber can be prevented from dropping out of conveyor belt when being patted. Having been squeezed and degummed by the mechanical rubbing area 102, the bast fiber is fed onto the conveyor belt of the trash cleanup area 103 where dusts and gum particles dropped out of bast fiber are discharged from the via holes of the conveyor belt 110 through intermittent patting by the upper and lower pat rollers 111, 112.

The discharging area 104 includes a discharging platform 114 designed with holes 115 on the upper surface, the dust and gum particles of bast fiber are dropped through the holes on the discharging platform 114 by further cleanup with manual or the mechanical shaking. The last step is to bunch the degummed fiber into bundles.

The trash cleanup device 105 includes a dedusting hood 116 connected with an exhaust blower and disposed above the mechanical rubbing area 102 and the trash cleanup area 103, a trash cleanup conveyor belt 117 connected with a fan drum and disposed below the mechanical rubbing area 102, the trash cleanup area 103 and the discharging area 104, wherein the fan drum is connected to the exhaust blower (not shown).

In the above-mentioned embodiments, the upper and lower grooved rollers 106, 107 may have 10 to 40 pairs, preferably 20 to 30 pairs. The teeth of the upper and lower grooved rollers 106, 107 may be rounded teeth, straight teeth, trapezoid teeth, and so on, wherein the height of teeth may be 1 to 30 mm, preferably 10 to 20 mm; the width of which may be 5 to 30 mm, preferably 10 to 25 mm; the diameter of the upper and lower grooved rollers 106, 107 may be 100 to 200 mm, preferably 140 to 180 mm; the grooves of the grooved rollers 106 may be straight grooves or skewed grooves; the space between each pair of the upper and lower grooved rollers 106, 107 may be 0.1 to 2 cm, preferably 0.5 to 1 cm. During the operation, along the moving direction of bast fiber, the tooth number of the upper and lower grooved rollers 106, 107 increases, and the depth of groove decreases, and the pressure applied to the upper grooved rollers 106 by pressure control device 108 increases, thus it can effectively achieve the purpose of rubbing sufficiently and avoid damage to the gear teeth of the upper and lower grooved rollers 106, 107. The upper and lower grooved rollers 106, 107 also can be replaced by a rubber roller or a plate roller, but the degumming effect of these rollers is not as good as the grooved roller. The patting and shaking can be also performed manually rather than by the pat roller disposed in the trash cleanup area 103.

The operation processes of the mechanical degumming are as follows: firstly, the bast fibers are bunched into bundles to be fed between the upper and lower rollers, and then the bast fibers are squeezed and rubbed repeatedly by the rotation of the adjustable motor in the forward and backward directions, so as to crush and separate the gum in the bast fibers; secondly, when the fibers are delivered by a conveyor belt, the gum particles and dust on the fibers are removed by manually or mechanically patting; lastly, the treated bast fibers are bunched into bundles after being further cleaned by manually or mechanically shaking 2. Yarn Hanging Rack The yarn hanging rack is used to hang hemp fibers in the processes of the biological degumming, the high temperature digesting and degumming and the high temperature bleaching and washing, thus, it will be described separately.

Figure 3:
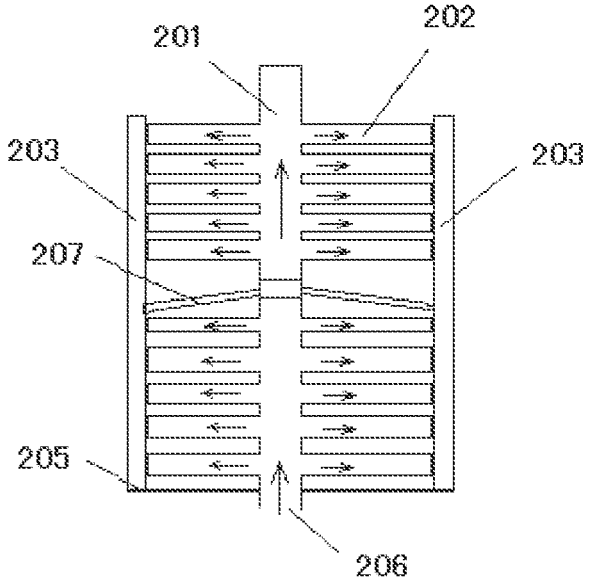
FIG. 3 shows a schematic front view of the yarn hanging rack in accordance with the present disclosure.
Figure 4:
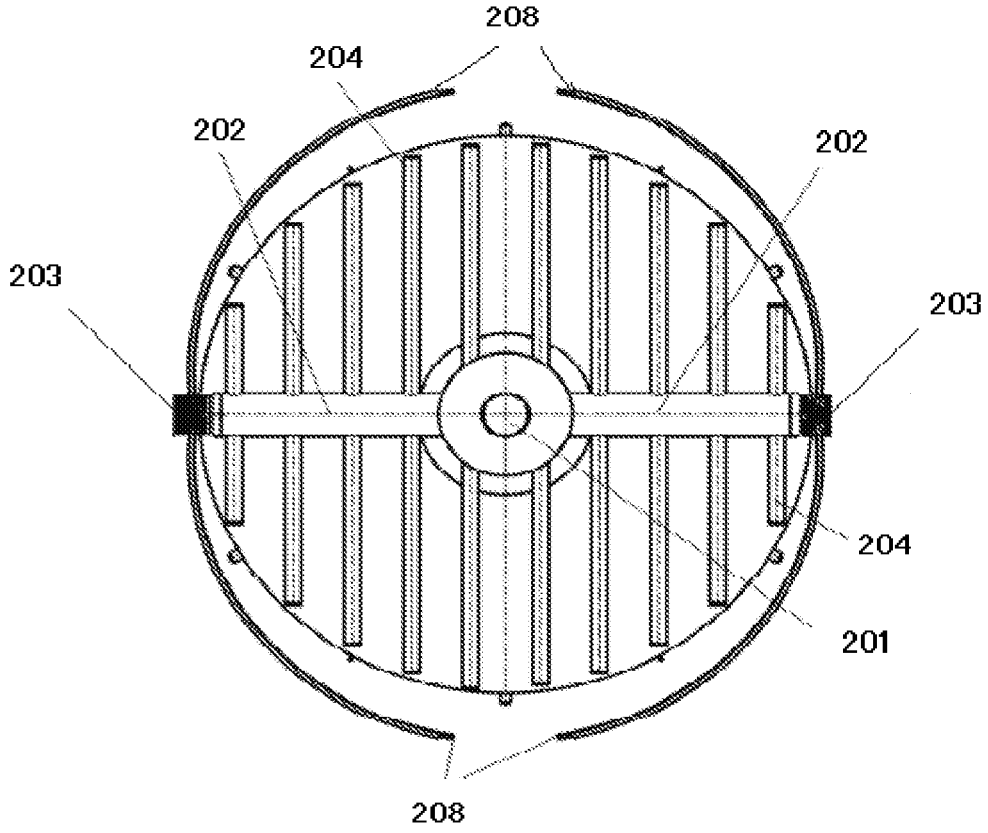
FIG. 4 shows a top view of FIG. 3.

As shown in FIG. 3 and FIG. 4, the yarn hanging rack includes a hollow post 201, wherein the left and right sides of the hollow post 201 are separately symmetrically designed with a plurality of layers of hollow beams 202 from up to down, each of which communicates with the hollow post 201, and the outer end of each hollow beam 202 of each side is connected to form an integrated unit through the same support post 203 which is scalable. A plurality of horizontal hanging rods 204 which are vertical to the hollow beams 202 are disposed at a certain interval on the two hollow beams 202 of the top layer, wherein each hanging rod 204 communicates with the hollow beams 202 and is designed with a plurality of holes. A plurality of spraying rods (not shown) are disposed with a certain interval on each hollow beam 202 of the second layer and the below layers, wherein the spraying rods communicate with the hollow beam 202 and are located corresponding to a respective hanging rods 204, in which the spraying rods are designed with a plurality of spraying holes. The bottoms of the hollow post 201 and the support post 203 are connected with a creel chassis 205 designed with meshes, and the terminal end of the hollow post 201 is disposed with a pipeline connector 206.

In the above-mentioned embodiments, generally, the holes on the first layer of the hanging rod 204 are disposed on the upper half of the rod, that is to say, the holes are disposed in a row on the top and the portion slightly above two sides of the rod, so that the water sprayed out of the holes sprays to the bast fiber on the top of the rod to eliminate the dead angle of processing. The holes of the spraying rods of the second layer and the below layers may be only disposed on two sides rather than the top.

The top of the hollow post 201 is closed and disposed with a hanger, and the yarn hanging rack can be hung into the main cylinder by a lifting device, wherein the pipeline connector 206 on the bottom of the hollow post 201 is connected with a liquid inlet pipeline.

During the processes of the biological degumming, the high temperature digesting, and the high temperature bleaching and washing, a plurality of the serial or parallel yarn hanging racks can be employed. When the yarn hanging racks are connected in parallel, each yarn hanging rack is disposed with a hanger at the top. When the yarn hanging racks are in series, the top of the hollow post 201 of the topmost yarn hanging rack is closed, while the top of the hollow post of each yarn hanging racks below the topmost one is open, and the pipeline connector 206 at the bottom of the hollow post 201 of the lowermost yarn hanging rack communicates with the liquid inlet, so that each hollow post communicates with each other to form one common water inlet pipe. In order that each yarn hanging rack forms a relatively independent operation space, a lid 207 is added between each layer of the yarn hanging racks to allow the treatment solution flowed from the upper area to flow out along the periphery of the lid 207. Therefore, non-uniform treatment effect on the upper and lower layers of the bast fiber can be prevented, while the upper layer impurity can be prevented from dropping into the lower yarn hanging rack. When the yarn hanging racks are disposed in parallel, the pipeline connectors disposed at the hollow post bottom of each yarn hanging rack are connected in parallel and circulation is performed by the main pump.

In the above-mentioned embodiments, an outer cylinder surrounding the whole yarn hanging rack can be disposed on two support posts 203, wherein the outer cylinder may employ four arc-shaped creel baffles 208 which are two-to-two symmetrically hinged to two support posts 203, therefore, the two creel baffles 208 located on two sides form two doors which may be closed and locked. In this way, as the hanging rod 204 is fully hung with the bast fibers, two pairs of the creel baffles 208 can be closed to form an integral outer cylinder suffused with water outlets.

In the above-mentioned embodiments, a layer of the hollow beams 202 also can be disposed on the hollow post 201, wherein a plurality of horizontal hanging rods 204 which are vertical to the hollow beams 202 are disposed with a certain interval on the two hollow beams 202, and each hanging rod 204 communicates with the hollow beam 202 and is designed with a plurality of holes.

During operation, bundles of the bast fibers are hung on the hanging rods side by side, then the distance between the hollow beam and the creel chassis is adjusted according to the length of the bast fibers, and when all the hanging rods are fully hung with bast fibers, the outer cylinder is closed and then the lid is nested into the hollow post, then the lifting device connects to the hanger and hangs the whole yarn hanging rack into the cylinder, and the pipeline connector at the hollow post bottom is connected to the main pump outlet through the pipeline and the main pump inlet is connected to the treatment solution storage device, at the same time, the main pump inlet is connected to the cylinder through the pipeline. Once the main pump is activated, the treatment solution can be pumped into the hollow post, and the treatment solution sprays onto the bast fibers through the holes on the hanging rod, then the dropped treatment solution may penetrate the meshes on the creel chassis and enter into the treatment solution storage device through the connecting pipeline, therefore, the whole treatment cycle is completed.

3. Biological Degumming Device

Figure 5:
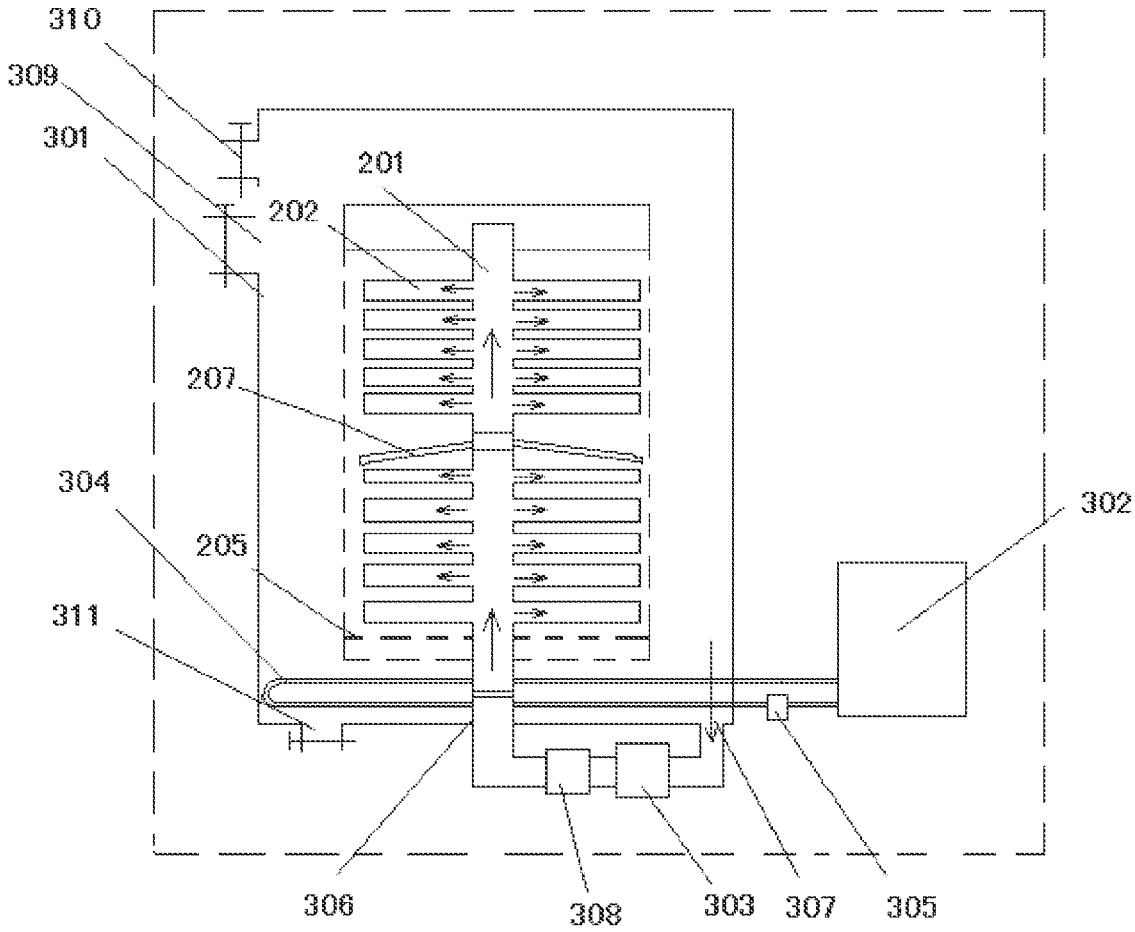
FIG. 5 shows a schematic view of the fermentation system of the biological degumming device in accordance with the present disclosure.
Figure 6:
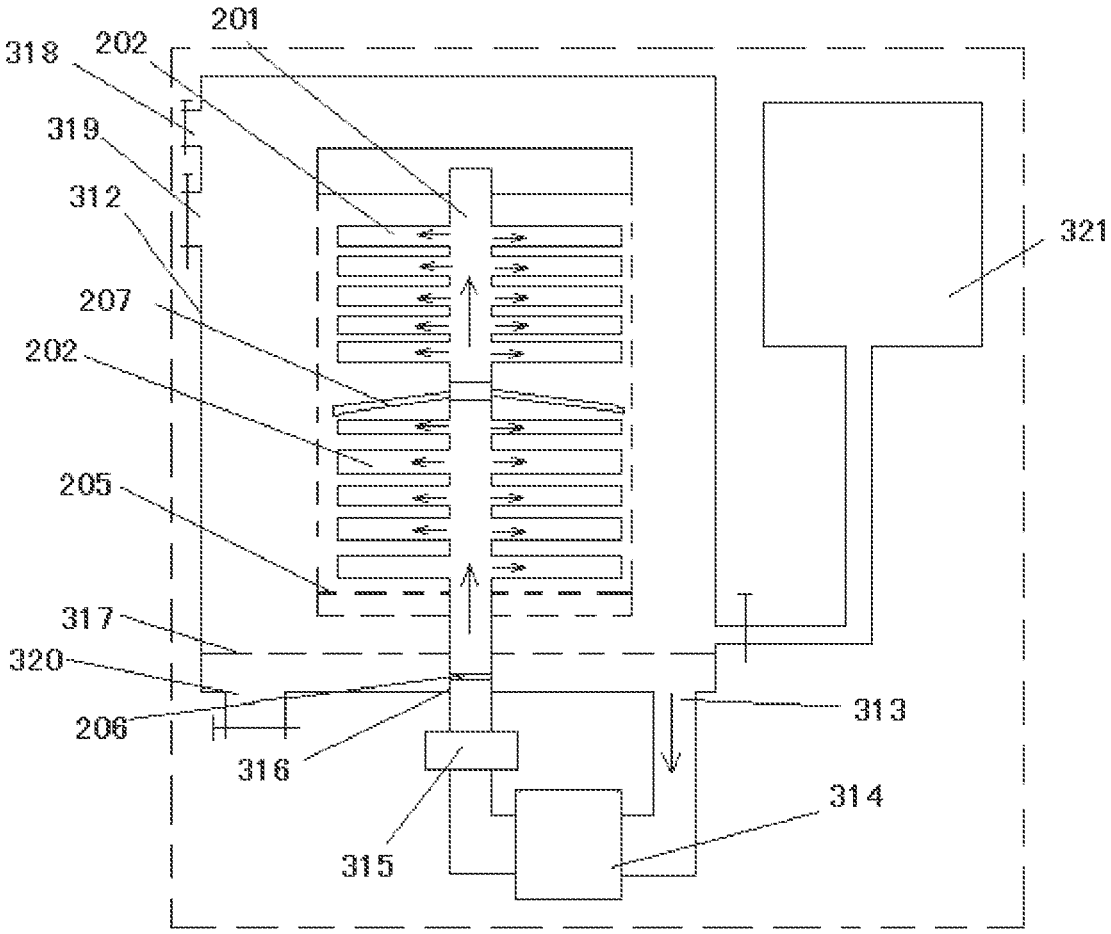
FIG. 6 shows a schematic view of the sterilizing system of the biological degumming device in accordance with the present disclosure.

As shown in FIGS. 5 and 6, the biological degumming device comprises a bio-fermentation system, an inoculation system, and a sterilizing system.

As shown in FIG. 5, the bio-fermentation system comprises a lidded main cylinder 301, a hot water bucket 302 and a main pump 303, wherein the inner wall or bottom of the main cylinder 301 is disposed with a coiled pipe 304, both ends of which are connected with the inlet and outlet of the hot water bucket 302 through pipelines, one of the pipelines is disposed with a pump 305 which drives water of the hot water bucket 302 to circulate between the coiled pipe 304 of the main cylinder 301 and the hot water bucket 302 during operation. The treatment liquid (culture fluid) is heated by the thermal dissipated from the coiled pipe 304 and maintained in a specified temperature range. The lower portion of the main cylinder 301 is connected with a liquid inlet 306 connected to the outlet of the main pump 303 through a compressed air pump, and a liquid outlet 307 connected to the inlet of the main pump 303, wherein the treatment liquid (culture fluid) of the main cylinder 301 may be circulated by the main pump 303, and the compressed air pump 308 can supply air to the treatment liquid (culture fluid), wherein the compressed air pump 308 is disposed with an air degerming filter. A water inlet 309 having a valve is disposed on the top of the main cylinder 301 which can be filled with water by opening the valve of the water inlet 309, the upper side of the main cylinder 301 is disposed with a liquid inlet 310 having a valve, and the culture fluid of the culture fluid tank can be supplied to the main cylinder 301 via the liquid inlet 310. A waste solution outlet 311 is disposed in the bottom of the main cylinder 301 for discharging the waste solution.

The inoculation system is substantially same with the bio-fermentation system in structure and connection, and comprises a main cylinder, a hot water bucket, and a main pump, thus the description of which will be omitted.

As shown in FIG. 6, the sterilizing system is comprised of a bucket shaped main cylinder 312 having a lid, the main cylinder 312 has a circulation liquid outlet 313 connected to a main pump 317, the outlet of the main pump 314 is connected to a heat exchange device 315 having an outlet connected to the circulation liquid inlet 316 disposed at the bottom of the main cylinder 312, a filter plate having holes is disposed at a lower portion inside the main cylinder 312, a water inlet 318 having a valve and a liquid inlet 319 having a valve are disposed in the upper side wall of the main cylinder, the main cylinder 312 can be filled with water and treatment liquid by opening the valves, a waste solution outlet 320 having a valve is disposed in the lower portion of the main cylinder, the waste solution in the main cylinder 312 can be discharged from the effluent solution outlet 320 by opening the valve. A secondary cylinder 321 is disposed outside the main cylinder 312 and is used to supplement chemical additives to the main cylinder 312.

Said yarn hanging racks are arranged in the main cylinders of the bio-fermentation system, the inoculation system and the sterilizing system.

4. The high temperature digesting and degumming and the high temperature bleaching and washing are performed with a same device and are described hereinafter. The circulation liquid processing on the "bast fibers" mentioned in the present disclosure comprises the circulation liquid processing on the yarn.

Figure 7:
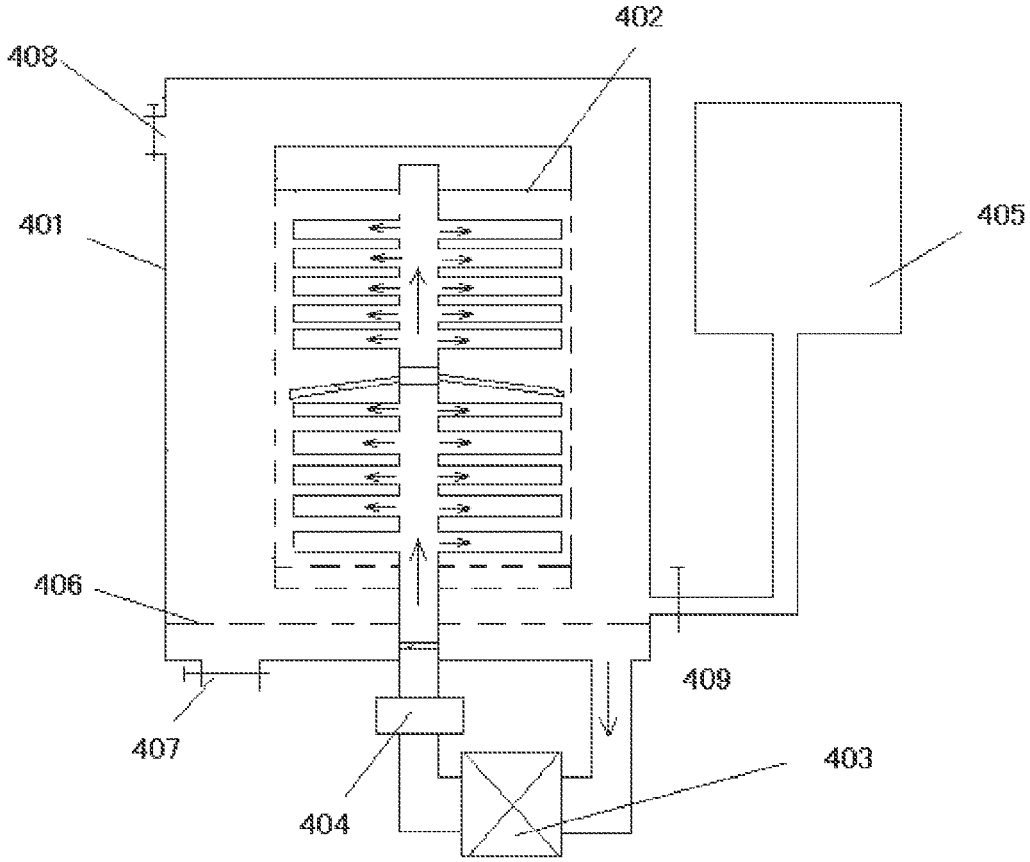
FIG. 7 shows a schematic view of the high temperature digesting and the high temperature bleaching and washing device in accordance with the present disclosure.

As shown in FIG. 7, the device comprises a bucket-shaped main cylinder 401 having a lid, which is disposed with a yarn hanging device 402, and there is a gap between the perimeters of the main cylinder 401 and the yarn hanging device 402. A main pump 403 is disposed outside the main cylinder 401 and has an outlet connected to the heat exchange device 404, the water outlet of the heat exchange device 404 connects to the water inlet of the yarn hanging device 402 in the main cylinder, and the water outlet of the main cylinder connects to the water outlet of the main pump 403. A secondary cylinder 405 is disposed outside the main cylinder, which is used to supplement chemical additives to the main cylinder.

The yarn hanging device 402 described herein can be one as described above, and a plurality of yarn hanging devices 402 can be disposed in the main cylinder 401 in series. A filter plate 406 is disposed at the lower portion inside the main cylinder 401, and a waste liquid outlet having a valve 407 is disposed in the pipe connecting the main pump 403 to the bottom of the main cylinder. Waste liquid in the main cylinder can be discharged through the waste liquid outlet by opening the valve 407. A water inlet 408 having a valve can be disposed in the side wall of the main cylinder 401 so as to supply water through the valve and the water inlet without opening the top lid of the main cylinder. A pipe having a valve 409 is disposed in the side wall of the main cylinder to connect the liquid outlet of the secondary cylinder. When opening the valve, the secondary cylinder can supplement chemical additives and other liquids to the main cylinder.

The differences between high temperature digesting and degumming and the high temperature bleaching and washing are different reagents added, different temperatures, and different circulation time. The above mentioned biological degumming can be performed in combination with the high temperature digesting, bleaching and degumming processes, wherein the former is performed before the latter. Both processes can be performed separately, that is to say, after mechanical degumming, the biological degumming or the digesting and degumming is performed, and then the high temperature bleaching and washing process is performed.

5. Separating and Water Washing Device

Figure 8:
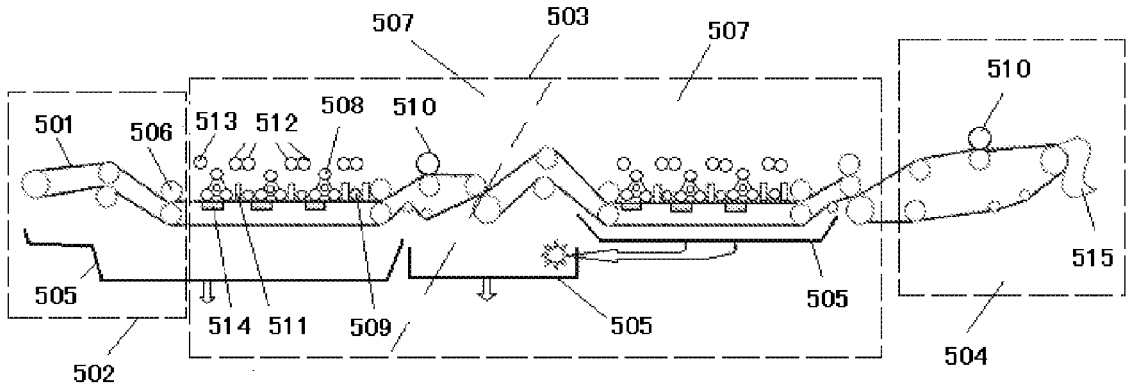
FIG. 8 shows a schematic view of the separating and washing device in accordance with the present disclosure.

As shown in FIG. 8, the separating and water washing device comprises a rack (not shown) disposed with a conveying belt 501. The conveying belt 501 is a holed conveying belt which is seamlessly interfaced, above which a feeding area 502, a separating and bleaching area 503, and an output area 504 are disposed, wherein parts of each working area are supported by racks, and each working area is associated with each other by the belt 501. A water collection tank 505 is disposed below the belt. The separating and water washing device is controlled by a variable frequency control unit.

The feeding area 502 is disposed at the starting end of the belt and mainly comprises a group of feeding rollers 506, and may further comprise a group of compression rollers for preliminarily rolling the hemp fibers and sending them into other working areas.

The separating and bleaching area 503 comprises several groups of identical separating and water washing units 507, preferably 3 groups, and compression rollers and feeding rollers identical to those in the feeding area which can be disposed between each water washing units. Each group of separating and water washing unit 507 comprises a plurality of spaced beaters 508 and separating rollers 509, and squeezing rollers 510 are disposed at the end of the last group of separating and water washing units. Bundle collecting plates 511 are disposed between the beater 508 and the separating roller 509, and between the separating roller 509 and the squeezing roller 510. The bundle collecting plate is fixed to the rack and used to gather hemp fibers on the belt 501 and prevent them shifting, and does not collide with the belt, rollers, and so on. A high pressure water pipe 512 is disposed above (not directly) the beater 508 and the separating roller 509, and a plurality of nozzles 513 are disposed in the high pressure pipe 512 for cleaning each beater 508 and separating roller 509, so as to avoid the roller being twisted by impurities and realize degumming by soaking the hemp fibers on the belt, wherein the hemp fibers can be soaked in 20-80° C. hot water in the high pressure pipe, so as to facilitate the degumming of the hemp fibers.

An impurity collecting tank (not shown) is disposed at a position near the upper and lower locations of the front and rear sides of the beater 508 and in the tangential direction of water spilling. Both sides of the impurity collecting tank are fixed to the rack by fasteners and there is a gap between them, also there is a gap between the bottom of the impurity collecting tank and the belt. The impurity collecting tank may collect water and impurities spilled by the hemp fibers and each roller, which are the result of a high pressure spout sprayed to the hemp fibers and each roller, and discharge the collected water and impurities through a single pipe connecting the impurity collecting tank to the outside, so as to ensure that the beater and the separating roller are clean. At the bottom of the belt, an arch steel bracket plate 514 is disposed corresponding to the hit point of the beater 508, the midst part and two sides of the bracket plate 514 are positioned in the rack slides of two sides, in which the front and rear ends along the belt movement direction are moveable ends, thus the bracket plate can move up and down as well as forward and backward, and the beating force of the beater can be controlled by the up and down movement, while the beating distance of the beater can be controlled by the forward and backward movement. Therefore, the bracket plate can be disposed in order to increase the beating force and the vibration of the belt, so as to decrease a bonding force between gum and fibers for facilitating degumming. The squeezing rollers 510 are a group of synchronous rollers consisted of two squeezing rollers respectively disposed above and below the belt. The liquor retention of the squeezing roller can be adjusted by a pneumatic device.

A squeezing roller and bundle collecting plate can also be disposed in the output area 504, immediately after the squeezing roller, a hemp arranging mechanism 515 is disposed under the belt end with a certain offset. After being separated and washed by a plurality of working units, the hemp fibers move following the belt, are squeezed by the squeezing rollers, then fall into the hemp arranging mechanism after forming a hemp band by swinging to and fro, wherein the hemp arranging mechanism is a mechanism which is driven by a hopper shaped connecting rod to make a to-and-fro movement along an arc.

The operations of the above working areas are controlled by a variable frequency control unit, wherein the operation speeds of various working areas can be the same or different; and the operation speeds of various working units of the water washing area can be the same or different.

In the above embodiments, the separating rollers 509 located in the front end and intermediate portion of each separating and water washing unit have straight grooves parallel to the axis on their surfaces, which is used to limit the fibre position by compaction when fibres are beaten. A plurality of annular grooves are disposed in the surfaces of the separating roller 509 near the output end of the separating and water washing unit and are used to separate and combine the fibres. Additionally, according to the arrangement order of the separating and water washing units, the pitch and depth of the grooves of the separating roller 509 can be decreased gradually to make the separated fibres tidier.

Figure 8A:
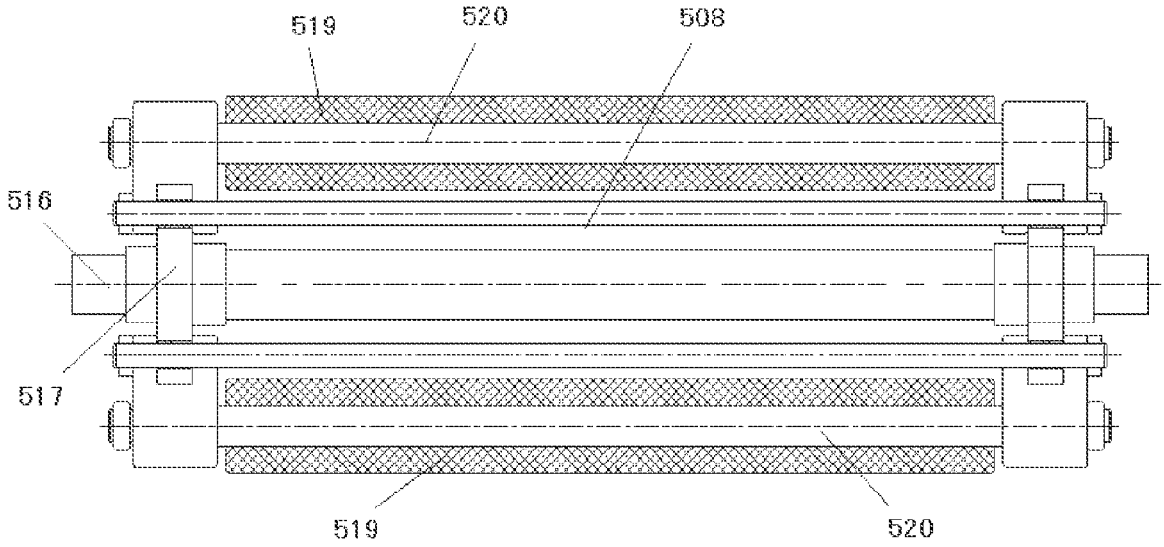
FIG. 8A shows a schematic view of an embodiment of the beater in the separating and washing device.
Figure 8B:
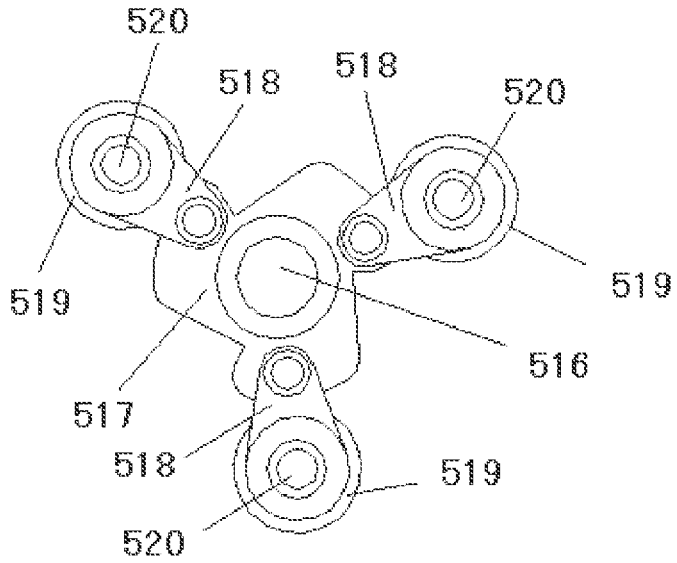
FIG. 8B shows a side view of FIG. 8A.

In the above embodiments, the beater 508 may employ various structures. As shown in FIGS. 8A and 8B, the beater 508 may comprise a main shaft 516 driven by a motor, wherein both ends of the main shaft 516 are respectively connected to a connection plate 517 having 3 convex ends, each of which is connected to a swing stem 518, the other ends of every two correspondingly arranged swing stems are connected with the two ends of the main shaft 520 of a planet roller 519, wherein the surface of each planet roller 519 is covered by a glue layer and the main shaft 516 is connected with the motor through a driving mechanism. When the main shaft 516 is driven to rotate by the motor, each swing stem 518 is driven to revolute by the connection plate 517 of both ends, when the 3 planet rollers 519 revolute under the driving of each swing stem 518 on both ends, it also swing about the connection point of swing stem 518 as an axis, at the same time, each planet roller 519 may also rotate about the centre axis 520. When said beater 508 is driven to rotate, each planet roller 519 heavily drops under the effects by driving force and weight, and forcefully beats fiber bundles on the belt in connection with a bracket plate, so as to weaken the bonding force between gum and fibers and facilitate degumming, at the same time, the fiber degumming can be improved by the high pressure spraying and the high pressure water pipe and separating operation can be improved by the separating roller 509.

Figure 8C:
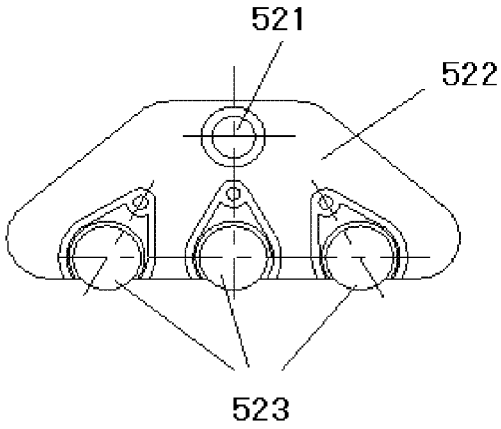
FIG. 8C shows a schematic view of another embodiment of the beater in the separating and washing device.
Figure 8D:
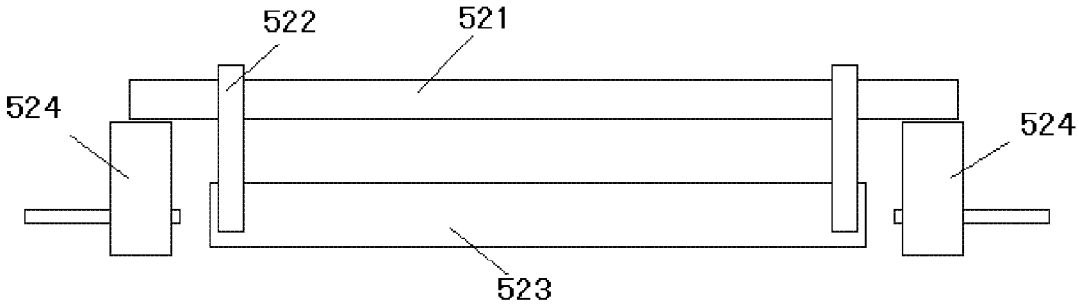
FIG. 8D shows a side view of FIG. 8C.

As shown in FIGS. 8C and 8D, the beater 508 may also comprise: a main shaft 521, wherein both ends of the main shaft 521 connect with a connection plate 522, 3 beating rollers 523 are connected in parallel to the connecting plate 522 on both ends, a cam 524 is disposed on both ends of the main shaft 521, the cam 524 on each end is supported on the both sides of the rack belt through cam shafts, each of which connects with the motor through the driving mechanism. When the motor drives the cams 524 on both ends to rotate, the cam can vertically lift beaters 508 by pressing the main shaft 521, then letting it vertically drop to beat fibers. In addition to various beaters 508 hereinabove, those utilized in prior art can be equivalently utilized; in particular, the beating frequency of the beater 508 of the present disclosure can be adjusted through a variable frequency motor.

6. Washing and Softening Device

Figure 9:
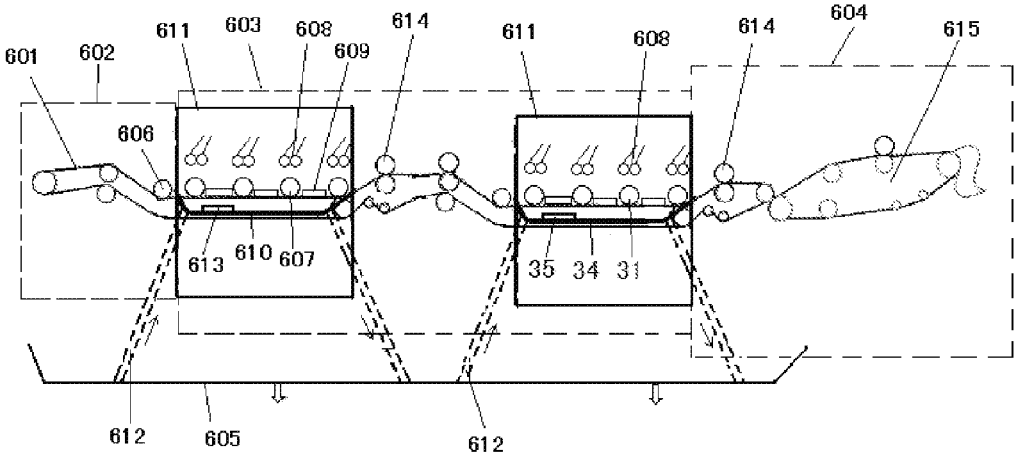
FIG. 9 shows a schematic view of the washing and softening device in accordance with the present disclosure.

As shown in FIG. 9, the device comprises a rack (not shown) on which an output belt 601 is disposed, wherein the belt 601 is a meshed one seamlessly interfaced, and different parts are disposed above and below the belt 601. The whole belt can be divided into a feeding area 602, a washing and softening area 603 and an output area 604, the parts of each working area are supported by the rack, and each working area is linked by the belt. A water circulation device 605 is disposed under the rack. A variable frequency motor (not shown) is disposed outside the rack for controlling the operation of each part.

The feeding area 602 is disposed at the starting end of the belt 601. The feeding area mainly comprises a feeding roller 606 disposed above the belt and used to feed the hemp fibers to the washing and softening area 603. A group of squeezing rollers can be disposed before the feeding roller 606 so as to squeeze excess water carried in the previous process from the hemp fibers, and thus facilitate feeding.

A hot water tank 34 is disposed under the belt and the water level in the hot water tank shall ensure the fibers on the belt 601 being immersed. A heating device 35 is disposed in the hot water tank 34 for keeping water temperature between 20-100° C. by various methods, such as electric heating. The washing and softening area 603 may comprise a hot water tank 34, a belt 601, a separating roller 31 and a spraying pipe 608, all of them are housed in a shell 611 for keeping temperature of water in the hot water tank 34.

The washing and softening area 603 is next to the feeding area 602 and comprises a plurality of spaced separating rollers 607 disposed along the traveling direction of the belt, and the separating rollers 607 are ones having a plurality of spaced longitudinal grooves along the circumferential direction, wherein the grooves have a width of 1-30 mm, a depth of 1-50 mm, and a groove pitch of 1-50 mm. There is a small gap between the separating roller 607 and the belt, and the centre axis is supported on the rack at two ends. A high pressure spraying pipe 608 is disposed above each separating roller 607 and has a row of nozzles facing the separating roller 607 for rinsing the roller so as to prevent the roller from being twisted by impurities, and a softener is added into the water to soften hemp fibers and degum. A group of anti-deviation baffles 609 are disposed between every two neighboring separating rollers and on the rack near both sides of the belt 601 and above the belt 601, and the baffles 609 are fixed to the rack. The function of the anti-deviation baffles 609 is to gather the hemp fibers on the belt 601, so as to prevent the fiber from deviating and dropping. A hot water tank 610 is disposed below the belt, wherein the water level in the tank 610 can ensure the hemp fibers on the belt being immersed in the water. A heating device 613 is disposed in the hot water tank to keep the water temperature between 20-100° C. by various heating methods such as electric heating. The washing and softening area 603 may comprise a hot water tank, a belt, separating rollers, and spraying nozzles housed in a shell 611. The water circulation pipe 612 is connected between the hot water tank 610 and the water circulation treatment device 605. The hot water tank 610 can be added with a proper quantity of reagents the same as those added into the spraying pipe 608, so as to ensure a sufficient bleaching and washing effect. Such a combination of the separating roller 607, the spraying pipe 608, the hot water tank 610, the heating device 613, and the shell 611 may comprise several groups connected in series, wherein each group can have different temperatures and reagents.

The washing and softening area 603 is followed by the output area 604 which comprises two squeezing rollers 614 to roll on the belt together. Also, an anti-deviation baffle can be disposed between the separating roller 607 and the squeezing roller 614. At the end of the belt 601, a hemp arranging mechanism 615 is disposed in the turnaround area in connection with the belt, which regularly swings to and fro in the travel direction of the belt. When the fibers output by the belt drops to the hemp arranging mechanism, they are piled in a folded way as the hemp arranging mechanism swings.

In the above embodiments, the squeezing rollers at both the front end and the rear end appear in pairs, wherein the one above the belt and the one below the belt constitute a group of synchronous rollers. The liquor retention of the synchronous squeezing rollers can be adjusted by a pneumatic device (not shown), for example, a cylinder located on the rack, the piston of the cylinder connected to the squeezing rollers above the belt, thus the gap between the upper squeezing roller and the lower squeezing roller can be controlled by adjusting the expansion amount of the piston.

The operations of the above various areas are controlled by variable frequency motors in such a way that one variable frequency motor controls a plurality of rollers simultaneously or in such a way that one variable frequency motor controls one roller.

7. Hemp-Softening Oil Applying Device

Figure 10:
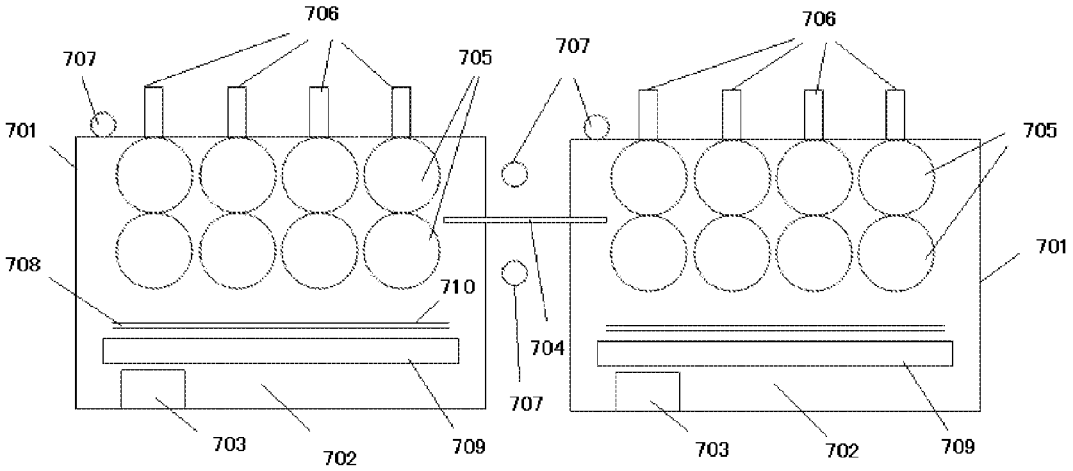
FIG. 10 shows a schematic view of the mechanical softening device in accordance with the present disclosure.

As shown in FIG. 10, the device comprises a rack 701 having more than two groups of working units 702, each of which is powered by a variable frequency motor 703, and the speed and direction of each part within the units are controlled by the variable frequency motor. Two neighboring working units are connected by a support plate 704 having a central slot. Each group of working unit comprises several pairs of parallel arranged rollers 705, and there is a gap between neighboring pairs of rollers 705, and each pair of rollers 705 are engaged vertically, and the central shaft of each roller is fixed to the two sides of the rack. A corresponding pressurizing device 706 is disposed on the top of each upper roller, which may utilize a cylinder (not shown) mounted on the rack to perform pressurizing, and the protrusion end of the cylinder corresponds to each upper roller 705. When started, the protrusion end of the cylinder pressurizes each upper roller 705, thus the gap between each upper roller and the lower roller decreases because of the weight of the upper roller and the pressure resulted from the pressurizing device, so as to enable pressing the degummed hemp between the upper and lower rollers.

A high pressure spraying oil pipe 707 is disposed above the first pair of rollers 705 of the first group working unit with an offset, a plurality of fan shaped high pressure oil nozzles are disposed in the spraying oil pipe, and also a high pressure spraying oil pipe 707 having a plurality of fan shaped high pressure oil nozzles are disposed above and below the support plate 704. The hemp-softening oil is uniformly sprayed onto the degummed hemp passing the first pair of rollers and the upper portion of the support plate via each nozzle, and the degummed hemp is also uniformly sprayed with oil via the slot in the support plate by each nozzle located at the lower portion of the support plate, then the hemp-softening oil infiltrates into the degummed hemp to soften it. An oil-impurity separation device 708 is disposed below each lower roller 705, and an oil recovering device 709 is disposed below the oil-impurity separation device for recycling oil from which impurities have been removed by the oil-impurity separation device so as to save on process costs. The oil-impurity separation device 708 comprises two layers of filter webs 710 made of stainless steel, there are grooves disposed in the both sides of the rack which corresponds to the positions of the two layers of the filter webs, and the both ends of the filter web are inserted in the corresponding grooves to enable replacement. When one of the filter webs 710 is stained and needs to be washed, it can be removed without influencing the continuous operation of the device.

In above embodiments, each roller 705 is one having grooves, or a rubber roller or plate roller. The upper pressurizing device 706 may utilize a hydraulic way or a spring to increase pressure, and in the present disclosure, air pressure is utilized to increase pressure. The variable frequency motor 703 performs variable control on each roller 705 to make each pair of rollers reciprocate and rotate forward and backward. In the present disclosure, the onward time is 0-5 seconds, preferably 0.5-1.2 seconds; while the backward time is 0-5 seconds, preferably 0.4-1.1 seconds. The rotation speed of each roller is 0-30 rpm, preferably 15-25 rpm. In the present disclosure, the fed degummed hemp is repeatedly squeezed and rubbed through the weight of each upper roller 705 or the force applied by the pressurizing device 706, as well as the reciprocation and forward and backward rotation of each pair of upper and lower roller 705, so as to make the hemp fibers soft and loose. At the same time, the hemp-softening oil is uniformly sprayed to the loose degummed hemp via a plurality of upper and lower fan shaped spraying oil nozzles, and is infiltrated into the degummed hemp through the repeatedly rolling by of each upper and lower roller 705, thus the mechanical hemp-softening process is completed.

8. Permeating and Reconditioning Device

Figure 11:
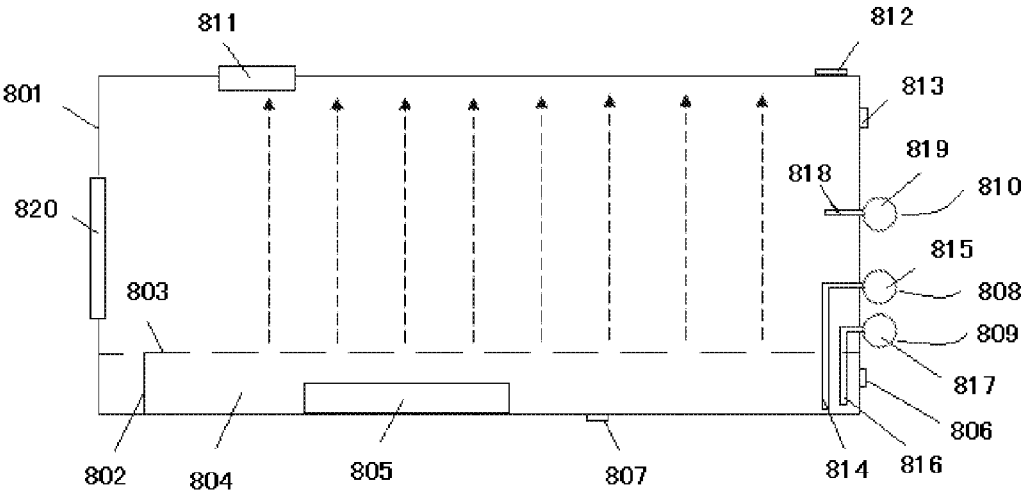
FIG. 11 shows a schematic view of the permeating and reconditioning device in accordance with the present disclosure.

As shown in FIG. 11, the device comprises a closed chamber 801, the inner top of the closed chamber is slanted so as to prevent condensed water dropping to the hemp being reconditioned, or the hemp will be dampened. A hemp fiber stacking device is disposed in the chamber 801, which can be a meshed plate 803 arranged on a support 802 or a hack lever suspending in the chamber through hooks. The chamber is filled with a certain amount of water, thus a water tank 804 is formed at the bottom of the chamber. A heating device 805 communicating with the water tank 804, a water injection valve 806, and a drain valve 807, a water level control device 808, a water temperature control device 809, a barometer 810 for measuring the air pressure in the chamber, a vacuum pump 811 for controlling the air pressure in the chamber, a safety valve 812 and a vent valve 813 are disposed in the chamber.

When the device is utilized to perform hemp fiber permeating and reconditioning, the hemp fibers are arranged on the meshed plate 803, and the water level shall be lower than the meshed plate 803. The heating device 805 can heat the water in the water tank to produce steam which permeates into various portions of the hemp fibers. The water level control device 808 comprises a water level sensor 814 disposed in the water tank and a water level display 815 disposed outside the chamber for displaying the water level sensed by the water level sensor. The water temperature control device 809 comprises a temperature sensor 816 inserted into the water tank and a temperature display 817 disposed outside the chamber for displaying the water temperature detected by the temperature sensor. The barometer 810 comprises an air pressure detector 818 disposed in the chamber and an air pressure display 819 disposed outside the chamber for displaying the air pressure detected by the air pressure detector. The vacuum pump 811 is used to evacuate the chamber, that is to say, to pump out dry air in the chamber. The safety valve 812 is used to automatically adjust the air pressure in the chamber so as to keep the air pressure in the chamber in an acceptable maximum range. The vent valve 813 is used to vent air after reconditioning. The chamber has an air-tight gate 820 having a window and which is used as a passage for laying hemp fibers.

The heating device 805 can be a heating water pipe through which high temperature steam or water passes, so as to heat the water in the water tank. The heating device may also be an electric heating rod having good thermal conductivity.

In the above embodiments, when the hemp fibers are laid on the meshed plate 803, the air-tight gate 820 is preferably slightly higher than the meshed plate. The support 802 and the plate 803 have been correspondingly disposed with guides facing the air-tight gate 820, the meshed plate 803 can be easily delivered into the chamber through the guides, and the hemp fiber can be arranged evenly.

9. Stretch-Breaking and Carding Device

Figure 12:
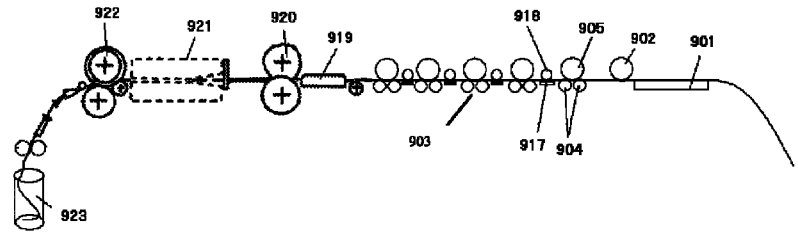
FIG. 12 shows a schematic view of the stretch-breaking and carding device in accordance with the present disclosure.

As shown in FIG. 12, the stretch-breaking and carding device of the present disclosure comprises a stretch-breaking mechanism, a bundle collecting device, a gill box, and a strip forming can. The stretch-breaking mechanism comprises a hemp feeding plate 901 disposed at the rack input end and a feeding roller 902 driven by a motor. Several groups of stretching units 903 are disposed at the front of the output end of the feeding roller 902, each of which is consisted of two lower support rollers 904 and one upper pressurizing roller 905 in a triangular configuration and connected with a shift device which is used to adjust the distances between each two stretching units 903.

Figure 12A:
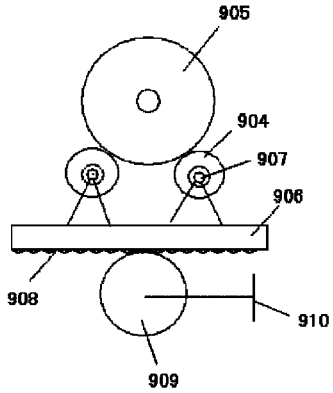
FIG. 12A shows a schematic view of the support plate shifting device in the stretch-breaking and carding device.
Figure 12B:
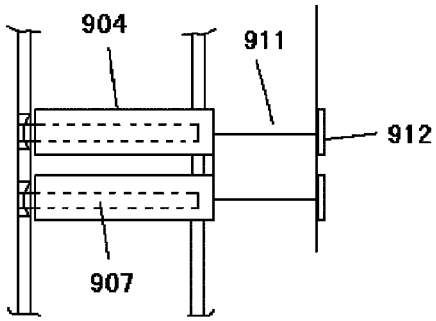
FIG. 12B shows a schematic view of driving the support roller in the stretch-breaking and carding device.

As shown in FIGS. 12A and 12B, the shift device comprises a support plate 906, the shafts of two support rollers 904 of each stretching unit retractably pass through a shaft bush 907, the shaft bush 907 is supported on the support plate 906 which has a teeth bar 908 arranged on its bottom, the teeth bar engages a gear wheel 909 supported on the rack. The gear wheel can be driven to sway by swaying the crank 910 of the gear wheel 909, and the support plate 906 is driven to move to and fro by engaging the gear wheel and the teeth bar, so as to adjust the distance between each two stretching units. Because the support roller 904 can be driven by the support plate 906 to move to and fro, two ends of the two support rollers 904 connect with a universal joint transmission shaft 911 respectively, and the other two ends connect with transmission gear 912 which can be driven by a motor through a driving mechanism. When the transmission gear rotates, the two support rollers 904 can be driven to synchronously rotate through the universal joint transmission shaft. When the two support rollers move following the support plate, the universal joint transmission shaft 911 can move as the transmission angle varies, the retractable connection between the shaft bush 907 and the support roller 904 may solve displacement resulted from shaft orientation, the friction force between the support roller 904 and the pressurizing roller 905 can be increased by employing a groove roller as the support roller.

Figure 12C:
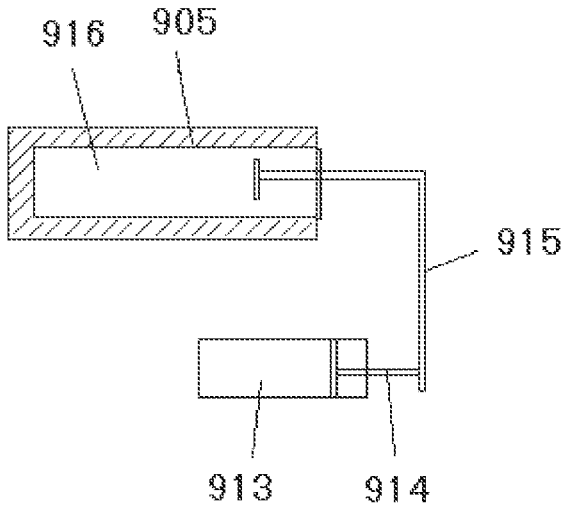
FIG. 12C shows a schematic view of pressurizing the pressurizing roller in the stretch-breaking and carding device.

As shown in FIGS. 12A and 12C, the pressurizing roller 905 is directly disposed on the two support rollers 904, and can apply pressure to the support rollers 904 under the effect of the pressurizing device. The pressurizing device can be a cylinder 913 disposed on the rack, the piston rod 914 of the cylinder connects with an L shaped arm 915, and the other end of the arm 915 protrudes into the center hole 916 from one end of the pressurizing roller 905. When the cylinder 913 drives the piston rod 914 to move outward along the cylinder axis, the other end of the L shaped arm 915 swings downward, which makes the pressurizing roller 905 move downward to apply pressure to the two support rollers 904. On the contrary, the pressurizing roller 905 is made to move upward to decrease the pressure on the two support roller 904. The pressurizing device may also be selected from a spring device, a hydraulic device, etc.

As shown in FIG. 12, a support roller 917 and a transition roller 918 are disposed between each two stretching units, so as to prevent fibers from dropping; there is a scraper (not shown) made from rubber and disposed near the two support rollers 904 in the stretching unit, so as to prevent fibers twisted around the support roller. In operation, the hemp fibers are clamped between the two support rollers and one pressurizing roller of each stretching unit, and are driven to advance by the rolling friction force between each support roller and the pressurizing roller. By adjusting the rotation speed of the two support rollers of the two stretching units, the rotation speed of the previous stretching unit is greater than that of the subsequent one, to elongate the hemp fibers. Because the present disclosure includes a plurality of stretching units, each of which performs stretching, the stretching unit located at the output end certainly can break long fibers into short fibers. That is to say, the main task of the stretching unit near the input end is to stretch and card the hemp fibers, while the main task of the stretching unit near the output end is to break the hemp fibers.

Figure 12D:
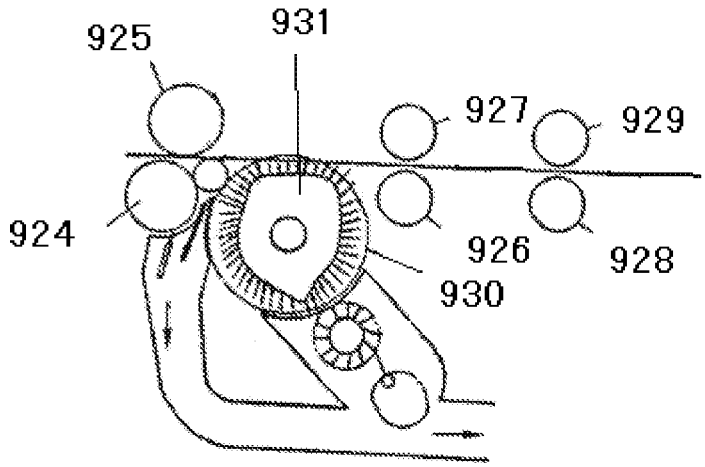
FIG. 12D shows a schematic view of the push-bar gill box in the stretch-breaking and carding device.

After stretch-breaking, the hemp fibers are fed to a conventional bundle collecting device 919, then the fiber layer of a certain width and a uniform thickness is fed to the roller 920 (or measurement roller of autoleveler), carded by the gill box 921, and output by the front roller 922. The fiber strips output by the front roller 922 are formed into ordered hemp strips via a strip output roller, a bellmouth, a coiler roller, etc., and then dropped into the strip forming can 923. According to various transmission methods of the gill bar, the gill box 921 generally has 3 types, such as screw rod type, chain type, and swiveling head type. In the present disclosure, the gill box 921 can also be a push-bar gill bar structure, as shown in FIG. 12D, which comprises a front roller 924, a front leather roller 925, a middle roller 926, a middle leather roller 927, and a rear roller 928, a rear leather roller 929, wherein a hollow side disc 930 having grooves is disposed between the front roller 924 and the middle roller 926, and a needle plate is disposed in the grooves, and the centre of the side disc is disposed with a cam 931, thus under the guiding by the cam, the needle plate slides along the cross section of the cam, wherein the cam 931 may also be in a roller shape.

10. Combing and Carding Device

Figure 13:
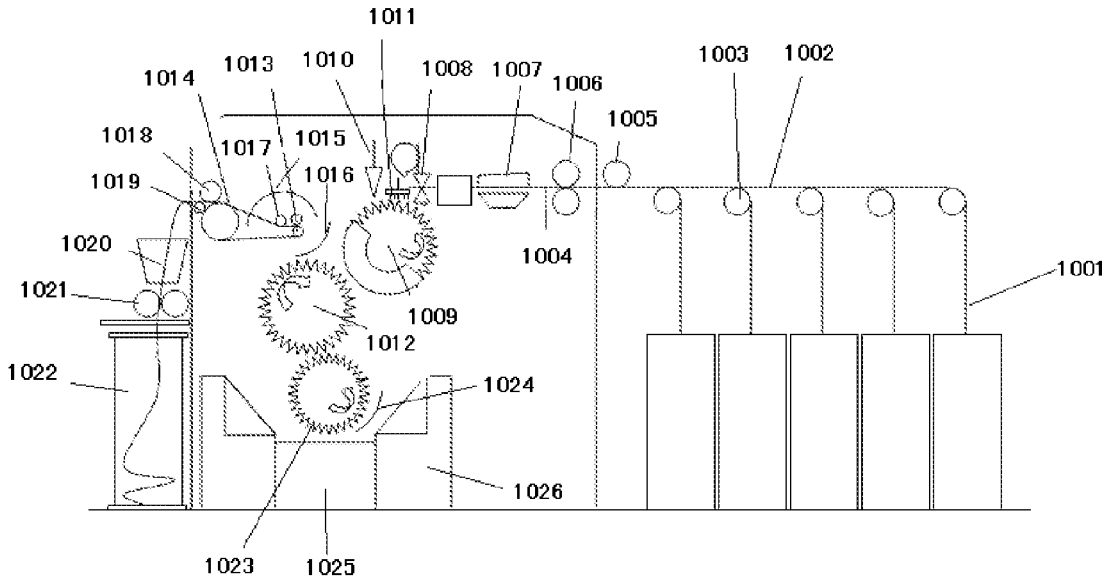
FIG. 13 shows a structural schematic view of the combing and sorting device in accordance with the present disclosure.

As shown in FIG. 13, the combing and carding device of the present disclosure has a similar structure as that in the prior art, that is to say, it also comprises a feeding mechanism, a nipping plate mechanism, a combing mechanism, a pulling and separating mechanism, a strip producing mechanism and a cleanup mechanism, etc. Current combing machines are front-portion-swing, intermittent straightforward combing machines characterized by the following properties: combining is performed intermittently and periodically, wherein the nipping plate mechanism and combing mechanism keep still, and the pulling carriage swings forward and backward, so as to enable combing fibers segmentally and directionally, and getting rid of hemp particles and foreign matters.

The feeding mechanism comprises a feeding rack 1001 with a plurality of hemp strip barrels 1002 holding hemp strips below it. The bundled hemp strips in each hemp strip barrel 1002 are hanged on the feeding rack 1001, and fed into the feeding roller 1006 through the strip guiding plate 1003, strip guiding roller 1004 and compression roller 1005. The feeding roller 1006 has a hemp holding plate below it, and the feeding roller 1006 feeds rows of hemp strips forward, which become loose, uniform, and straight hemp sheet after being combed by the feeding comb normally arranged in the feeding box 1007.

The nipping plate mechanism comprises a pair of nipping plates 1008 for nipping the whole row of hemp sheet and which can be engaged vertically, wherein the nipping mouth takes a right angle, having a plurality of engaging points for a large nipping force.

The combing mechanism comprises a top comb 1009 disposed at the output end of the nipping plates 1008, wherein a circular comb 1010 is disposed below the top comb. A blowing and collecting device is disposed near the nipping plates 1008, the top comb 1009 and the circular comb 1010, wherein a brush 1011 is mounted above the upper nipping plate and a brush 1012 is mounted below the circular comb.

The pulling and separating mechanism comprises a pulling carriage (not shown), wherein a pulling roller 1013, a pulling leather plate 1014, upper and lower breaking cutters 1015, 1016, a compression roller 1017 and a hemp output roller 1018 are mounted to the pulling carriage and formed into an integrated mechanism. The distance between the pulling point of the pulling roller 1013 and the nipping mouth is a pulling distance.

The strip producing mechanism comprises a strip guider 1019, a bundle collector 1020, and a crimper, a strip winder 1022, wherein the hemp strips are crimped by the crimping roller 1021 within the crimper and then delivered to the strip winder 1022 and loaded into barrels. The cleanup mechanism is arranged below the combing mechanism and the pulling mechanism and comprises a doffer 1023, a stripping comb 1024, a fallen hemp box 1025, and a dust box 1026, etc., as well as a dust collector for entraining flying hemp so as to ensure a good work environment and reduce workers' labor intensity.

A breakage automatic stop device and a hemp twisting automatic stop device are also disposed in the device. A full package automatic stop device is disposed in the packaging mechanism, and an advanced programmed logic controller (PLC) is employed to realize complete automation control, wherein, power source, transmission mechanism and compressor are conventional equipments, and descriptions of which is omitted for clarity.

The combing and carding device is different from that in the prior art in the following aspects.

The combing mechanism of the present disclosure increases the gill bar range of the circular comb from 220° in prior art to 270° in the present disclosure; at the same time, the circular comb employs a plurality of forms, such as a full teeth-bar-type needle strip and a teeth-bar-type needle strip combined with a gill bar-type needle strip, wherein the teeth-bar-type needle strip is in the front of the gill bar-type needle strip; the top comb also can employ two forms, one of which has only one row of needle strip and another of which has at least two rows of needle strip. Both the circular comb and the top comb can be designed with different specifications according to the specific process requirements.

In the pulling mechanism of the present disclosure, the pulling carriage can be moved upward and downward or forward and backward to adjust the pulling distance, so as to realize the length control; at the same time, by upward and downward movement, the hemp strips can be effectively jointed so that the hemp strips have more even weights. The pulling carriage is mounted on an adjusting bracket which is disposed with a bane on one side and designed with two arc sliding chutes inserted with a bolt respectively, which is fixed onto the rack, and the adjusting bracket can slide along the arc sliding chute by releasing the bolt and moving the bane to make the pulling carriage adjustable in both the up and down direction and the fore and back direction.

In the strip producing mechanism of the present disclosure, there are at least two pairs of the crimping rollers 1021 in the crimper, each pair of which are horizontal groove rollers, and the two pairs of the crimping rollers have different speeds wherein the rear pair of crimping rollers is faster than the front pair of crimping rollers, thus two of the rollers engage together to extrude hemp strips similarly as gears, so as to make the hemp strips to form a crimp shape, wherein different speeds are utilized to increase the curvature degree of the hemp fibers and thus improve the holding force of the hemp fibers. Baffles are arranged on the both sides of the crimping roller 1021 in the crimper, control the width of the hemp strip together with the crimping roller and form a strip output belt.

Based on the above description, the device of the present disclosure operates as follows: the hemp strips in strip barrels are delivered to the hemp holding plate via the strip guiding plate and the strip guiding roller, where the hemp strips are laid on the hemp holding plate evenly to form a hemp sheet which will be fed to the feeding roller, then the hemp sheet advances periodically as the feeding roller intermittently rotates. After entering into the feeding box, the hemp sheet is subjected to the control by the feeding comb in the feeding box, and advances to the opening formed by the upper and lower nipping plates while being entrained by the feeding box and the feeding comb. After entering the nipping plates, the front end of the hemp sheet overhangs on the circular comb, at this point, the upper and lower nipping plates close to clip the hemp sheet overhanging on the circular comb, then the hemp sheet is pressed into the gaps between needles by small hair brushes mounted to the nipping plate and is combed by the circular comb to sort out short fibers. At this point, the nipper plates are in the lowest position and are about 1 mm far from the circular comb, on which the needles of the comb are arranged in the circumference range between 0-270°, and the density of the needle is gradually increased and thus the fineness of the needle is gradually increased along the rotation direction, and the circular comb rotates with unequal speeds so as to ensure the circular comb realize excellent effects on the fibers.

The combed fibers become straight, short fibers and impurities are separated by the hair brush of the circular comb, wherein the speed of the hair brush is faster than that of the circular comb, so as to ensure cleaning effects. The separated short fibers are gathered by the doffer, severed by the stripping comb and fall into the fallen hemp box, while weeds are thrown into the dust box through a dust passage.

When the circular comb works, the pulling carriage moves backward to the circular comb, and the head of the fiber cluster enters into the pulling carriage, at the same time, the pulling roller makes a reverse movement to make the combed fiber cluster retreat by a specified length, so as to joint with newly combed fibers. In order to prevent the retreated fibers from being taken away by the circular comb, the lower breaking cutter performs the function of fencing the fiber cluster. When the circular comb has completed the combing operation (the circular comb rotates to the position where there is no comb needle), the upper and lower nipping plates open up and rise, at this point, the pulling roller rotates forward, the fiber cluster head held by a shovel is delivered to the pulling roller and joins with the fiber cluster returned by the pulling roller, at this time, the top comb descends so that the comb needles insert into the fiber cluster and comb the fiber cluster end. The pulling roller expedites the rotation, the upper breaking cutter descends, and the lower breaking cutter rises, so as to break the fiber cluster and the long fibers are pulled.

After being pulled, the fiber cluster is spread onto the leather plate, fed into the bundle collector, compressed by the compression roller, crimped by the crimping roller, aggregated into a hemp strip, and fed into a hemp strip barrel.

11. Root and Top Cutoff Device

Bast fibers cutoff can be performed manually or mechanically, and the present disclosure provides a practical device which can cut fibers quickly and control the fiber length.

Figure 14:
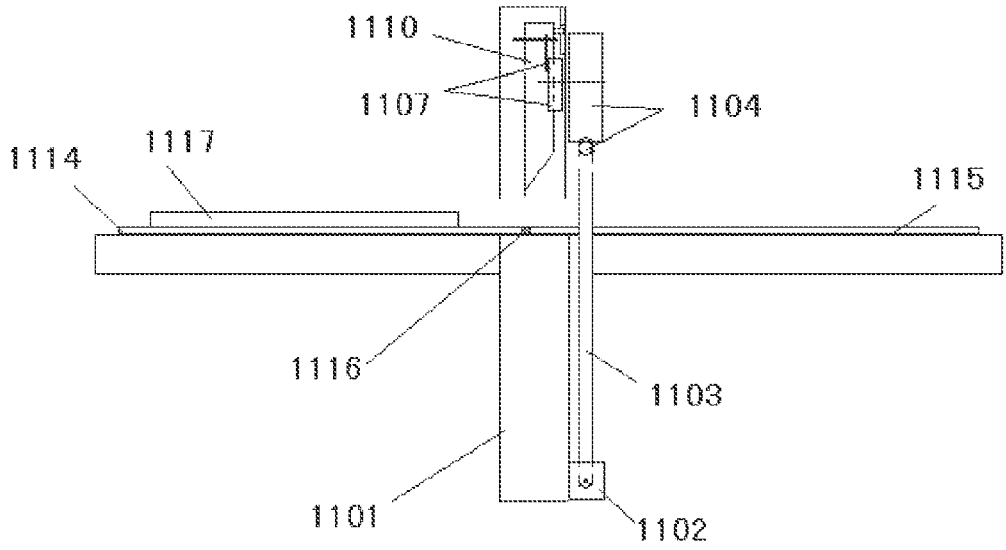
FIG. 14 shows a schematic view of the root and top cutoff device.

As shown in FIG. 14, the cutoff device comprises a door-shaped rack 1101 and a motor 1102 is positioned at the bottom of the rack 1101, wherein the driving shaft of the motor 1102 connects to a group of driving mechanisms 1103, such as a group of belt wheels driven by belts, or a group of chain wheels driven by chains, or a group of engaged gear wheels. The output ends of the driving mechanism 1103 connect with a group of worm and worm wheel mechanisms 1104, i.e., the output shaft of the driving mechanism 1103 connects to the worm 1105 which engages with the worm wheel 1106. The output end of the worm and worm wheel mechanism 1104 connects with a group of crank mechanisms 1107, i.e., the crank disc 1108 of which connects to the central axial by a socket joint, and the crank disc 1108 eccentrically connects to a connecting rod 1109. The portions, which are required to be supported, of the motor, the driving mechanism, the worm and worm wheel mechanism, and the crank mechanism are connected to the rack 1101.

Figure 14A:
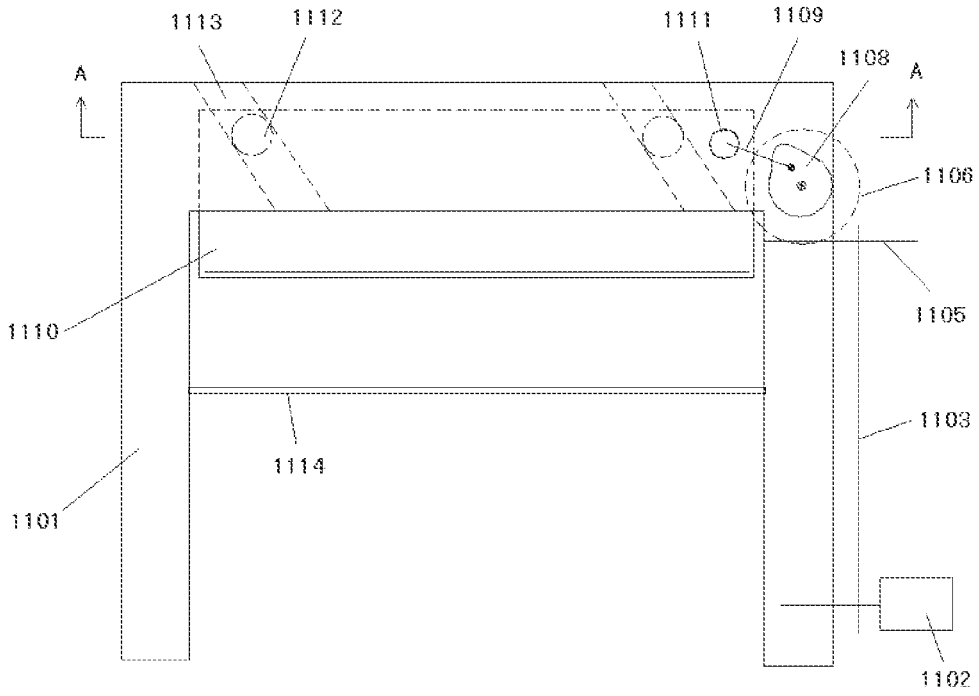
FIG. 14A shows a side view of FIG. 14
Figure 14B:
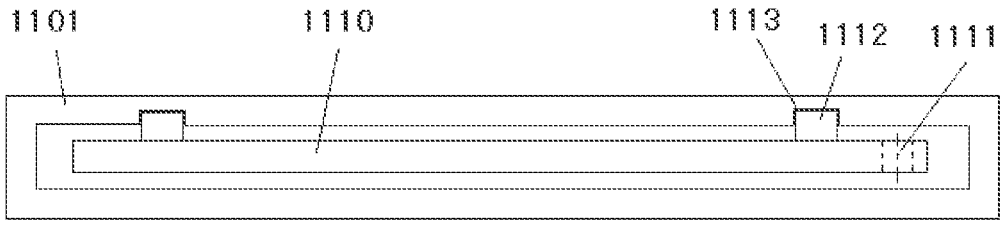
FIG. 14B shows a sectional view taken along A-A in FIG. 14A.

As shown in FIGS. 14A and 14B, in the groove below the rack 1101, an elongated cutter 1110 is disposed which spans between the two posts of the rack. One end of the cutter 1110 connects with the connecting rod 1109 via a pin 1111, while the other end is movably supported by the horizontal beam of the rack, wherein a guiding block 1112 is disposed on the cutter 1110, and the horizontal beam of the rack is designed with an inclined guiding groove 1113 for cooperating with the guiding block 1112; on the contrary, the inclined guiding groove can also be arranged in the cutter and the guiding block is arranged in the horizontal beam of the rack for cooperating with the guiding groove. The guiding block and the guiding groove may also be arranged at both ends of the horizontal beam so as to prevent the cutting from offsetting and shaking during moving.

As shown in FIG. 14, a feeding support plate 1114 and a discharging support plate 1115 are arranged on either side of the rack below the cutter 1110, wherein a cutter rest groove 1116 is connected between the feeding support plate 1114 and the discharging support plate 1115, and the cutter rest groove and the cutter above it face each other directly. Inside the cutter rest groove, a hard pad is positioned which can be made of rubber, plastic, bakelite, wood plastic composite, fiber plate, wood block, and the like, and can be replaced after being worn.

In the above embodiments, an automatic feeding device can be positioned on both the feeding support plate 1114 and the discharging support plate 1115, for example, an electric or pneumatic sliding support plate 1117 can be mounted on the feeding support plate 1114, and a travel switch (not shown) can be positioned in the worm and worm wheel mechanism 1104 or the crank mechanism 1107, so as to enable the sliding support plate 1117 to feed one time every time the connecting rod 1109 drives the cutter 1110 to make one cycle movement. In addition, the feeding support plate 1114, the discharging support plate 1115 and the sliding support plate 1117 can be designed with scale marks for exactly calculating a fiber breaking length, so as to control fiber length.

In use, the motor drives the worm of the worm and worm wheel mechanism through the output shaft of the driving mechanism, the worm drives the crank disc of the crank mechanism synchronously, and the crank disc drives the connecting rod eccentrically connected thereto so as to move; while the cutter moves following the connecting rod, the guiding block or the guiding groove of the cutter cooperates with the guiding groove or the guiding block to move aslant in an up and down direction, thus the cutter can realize an inclined cutting movement which expedites the process to break the bast fiber.

The above description is provided for a better understanding of the present disclosure, wherein the structure and connection of various parts can be modified, and any equivalent changes and modifications made based on the solutions of the present disclosure shall not be excluded from the scope defined by Claims.

What is claimed is:

1. A processing line of bast fiber including various devices for carding, cutting, degumming, high temperature washing, separating and water washing, softening, drying, applying hemp-softening oil, permeating and reconditioning, stretch-breaking and carding, and combing and sorting, wherein:

the cutting device includes a door-shaped rack with a motor disposed on one side, said motor drives a group of worm and worm wheel mechanisms through a driving mechanism, the worm wheel in said worm and worm wheel mechanism is coaxially connected to a crank disc of a crank mechanism, the crank disc is eccentrically attached with a connecting rod, an other end of the connecting rod is connected to a cutter which crosses two vertical beams of the rack, and is movably supported on a horizontal beam of the rack, the cutter and the horizontal beam have a correspondingly arranged guiding block and a guiding groove in inclined movement, two sides of the rack below the cutter are provided with a feeding support plate and a discharging support plate respectively, in which a cutter resting groove facing the cutter is connected between the feeding support plate and the discharging support plate, and at least one of the feeding support plate and the discharging support plate is designed with a scale for measuring fiber length;

the degumming device includes a mechanical degumming device, a biological degumming device, and a high temperature digesting and degumming device which is also used for high temperature washing;

the separating and water washing device includes a rack on which an endless holed conveying belt is disposed, and above the belt, a feeding roller, a compression roller, a plurality of beaters spaced apart and a separating roller are disposed sequentially, wherein a bundle collecting plate is disposed between the beater and the separating roller, and a high pressure nozzle is disposed above the beater and separating roller, a water collection tank is disposed below the belt, and an arranging mechanism is disposed at the end of the belt;

the stretch-breaking and carding device includes a sequentially disposed stretch-breaking mechanism, a bundle collecting device, a gill box and a strip forming can, in which the stretch-breaking mechanism includes a hemp-feeding plate disposed at an input end of the rack and a feeding roller driven by the motor, several groups of stretching units are disposed at a front of an output end of the feeding roller, each stretching unit provided with two synchronously rotational support rollers, and a rotating speed of the support roller in the front stretching unit is greater than that of the support roller in a rear stretching unit; a pressurizing roller driven by friction of the two support rollers is disposed on a top of each of the two support rollers, wherein a pressurizing device connected to the rack is disposed in a central axial of the pressurizing roller, the two support rollers are connected to a driving mechanism at one end and supported on a moving device at a bottom;

the combing and sorting device includes a feeding mechanism, a nipping plate mechanism, a carding mechanism, a pulling and separating mechanism, a strip producing mechanism, and a cleaning mechanism, wherein the feeding mechanism includes a feeding rack, a strip guiding plate, a strip guiding roller, a hemp holding plate, a compression roller, a feeding roller and a feeding box; the carding mechanism includes a circular comb and a top comb, in which needles of the circular comb are arranged in a circumference range between 0-270°, and density of the needle is gradually increased and a fineness of the needle is gradually reduced along a rotation direction; the pulling and separating mechanism includes a pulling carriage, a pulling roller, a pulling leather plate and a breaking cutter, wherein the pulling carriage is mounted on an adjusting bracket, the adjusting bracket is disposed with a bane at one side, and designed with an arc sliding chute inserted with a bolt which is fixed onto the rack, and the adjusting bracket can slide along the arc sliding chute by releasing the bolt and moving the barre; the strip producing mechanism includes at least two pairs of crimping rollers which are disposed with a horizontal groove in a surface; a breakage automatic stop device and a hemp-twisting automatic stop device are disposed in the carding mechanism and the pulling and separating mechanism, and a full package automatic stop device is disposed in a packaging mechanism.

2. The processing line of bast fiber as claimed in claim 1 wherein the mechanical degumming device includes a feeding area, a mechanical rubbing area, a trash cleanup area, a discharging area and a trash cleanup device, wherein the mechanical rubbing area includes upper and lower rows of the rollers set in pairs and driven by a drive motor, and the upper row rollers are disposed with a pressure control device respectively on a top of the two ends thereof, and the trash cleanup area includes a conveyor belt arranged with via-holes wherein at least two upper pat rollers are disposed above an upper band of the conveyor belt, and at least one lower pat roller located between two upper pat rollers in a transmit direction are disposed between the upper band and a lower band of the conveyor belt.

3. The processing line of bast fiber as claimed in claim 1, wherein the biological degumming device includes an inoculation system, a bio-fermentation system, and a sterilizing system, said inoculation system and said bio-fermentation system both include a lidded main cylinder, a hot water bucket and a main pump, wherein the main cylinder's liquid outlet is connected to the main pump's liquid inlet, while the main cylinder's liquid inlet is connected to the main pump's liquid outlet through a compression air pump; the main cylinder's inner wall is disposed with a coiled pipe having two ends respectively connected to a water inlet and water outlet of the hot water bucket via pipelines, in which one of the pipelines is disposed with a water pump;

said sterilizing system includes a barrel-shaped lidded sterilizing main cylinder, wherein a liquid outlet connected to the main pump is disposed at a lower portion of the main cylinder, and the main pump's water outlet is connected to a heat-exchanging device having a water outlet connected to a liquid inlet disposed at a lower part of the sterilizing main cylinder, and a filter plate with holes is disposed inside the lower part of the sterilizing main cylinder, and a secondary cylinder is further disposed outside the sterilizing main cylinder; and a yarn hanging device is disposed inside the main cylinders of said inoculation system, said bio-fermentation system, and said sterilizing system.

4. The processing line of bast fiber as claimed in claim 1, wherein said high temperature digesting and degumming device includes one barrel-shaped lidded main cylinder with a yarn hanging device disposed inside and a main pump disposed outside, wherein the main pump's water inlet is connected to the main cylinder's water outlet while the main pump's water outlet is connected to a heat-exchanging device, and the main cylinder is connected to a secondary cylinder from outside through a pipeline with a valve, wherein the secondary cylinder provides chemical additives.

5. The processing line of bast fiber as claimed in claim 4, wherein said yarn hanging device is a plurality of parallel or serial yarn hanging racks each including a hollow post, wherein the hollow post is closed at a top and disposed with a hanger, and left and right sides of the hollow post are separately symmetrically designed with a plurality of layers of the hollow beams communicated with the hollow post from up to down, an outer end of each hollow beam on each side is connected to form an integrated unit through a same support post, and a plurality of hanging rods communicated with the hollow beams are disposed at intervals on the two hollow beams of a first layer at the top, wherein an upper half of each hanging rod is disposed with a plurality of holes, and a plurality of spraying rods are disposed at intervals on each hollow beam of a second layer and below layers, wherein the spraying rod communicates with the hollow beam and is located correspondingly to a respective hanging rod, in which the spraying rod is designed with a plurality of spraying holes on a side thereof, and said hollow post and the support post are connected at bottoms to a creel chassis designed with meshes, wherein the hollow post is disposed with a liquid inlet on an end while the two support posts are disposed with a surrounding outer cylinder which is two-to-two symmetrically hinged to four creel baffles of two support posts, and the creel baffle is suffused with water outlets; and when a number of the yarn hanging racks with a cover body disposed between each of them are in series, a top of the hollow post of a topmost yarn hanging rack is closed, while a top of the hollow post of each yarn hanging racks below the topmost one is open and communicate with each other and the hollow post of a lowest yarn hanging rack is provided with a liquid inlet at a bottom; when a number of the yarn hanging racks are positioned in parallel, the liquid inlets at the bottom of the hollow post of each lowermost yarn hanging rack are connected in parallel so as to circulate via a main pump, and the hollow posts of each yarn hanging rack are all disposed with a hanger at the top.

6. The processing line of bast fiber as claimed in claim 1, wherein said washing and softening device includes a rack onto which a meshed belt is disposed, and a feeding roller, a separating roller, and a squeezing roller are disposed sequentially from conveying starting end to a terminal end of the belt, wherein the feeding roller and a carding roller disposed with a spray water pipe at a top are disposed above the belt, and said squeezing roller is disposed on an upper and lower surface of the belt symmetrically; a hot water tank for immersing the belt, disposed with a heating device inside, is provided below the belt, wherein the hot water tank protected in a shell is connected with a water circulation processing device at a lower end of the rack; an arranging mechanism is disposed at the terminal end of the belt.

7. The processing line of bast fiber as claimed in claim 1, wherein said hemp-softening oil applying device includes a rack disposed with at least two groups of squeezing-rubbing units in addition to a feeding unit, wherein neighboring squeezing-rubbing units are connected by a backing plate, and each group of squeezing-rubbing units includes several pairs of engaged upper and lower rollers which are driven by a variable frequency motor, and a roller located in an upper part is pressurized by a pressurizing device, and high pressure fuel injection pipes are disposed above an inlet of a first pair of rollers of a first group of squeezing-rubbing units and above and below the backing plate respectively, and an oil-impurity separation device is located below the lower roller and disposed with an oil recovery device therebelow.

8. The processing line of bast fiber as claimed in claim 1, wherein said permeating and reconditioning device includes a closed chamber filled with water, within which a hemp fiber arranging device is disposed, wherein an inner top of the chamber is a slope, and a heating device being supplied with water, an injection valve, a drain valve, a level control device, a water temperature control device, and a barometer for measuring air pressure within the chamber, a vacuum pump for controlling air pressure within the chamber, a safety valve and an exhaust valve are disposed on the chamber where a sealing door is disposed.

9. The processing line of bast fiber as claimed in claim 1, wherein in said separating and water washing device, an arch steel bracket plate is disposed at a belt bottom corresponding to an impacting point of the beater, wherein a midst and two sides of the bracket plate are disposed within rack slides of two sides, in which a front and rear end along the belt movement direction are moveable ends; said beater consists of three planet rollers covered with elastic rubber and spaced apart 120°.

10. The processing line of bast fiber as claimed in claim 1, wherein in said stretch-breaking and carding device, a shift device includes a support plate, by which two support rollers are supported, wherein with a rack bar, a bottom of the support plate is connected to a gear which has a crank and is supported on the rack, and the other ends of two support rollers are respectively connected to a universal joint transmission shaft with an other end connected to an output gear of a driving mechanism; in said stretch-breaking and carding device, said gill box is a push-bar gill bar structure and includes a front roller/leather roller, a middle roller/leather roller, and a rear roller/leather roller, wherein a hollow side disc having grooves is disposed between the front roller/leather roller and the middle roller/leather roller, and a needle plate is set in grooves, and the side disc is disposed with a cam at a center, thus under the guiding by the cam, the needle plate slides along a cross section of the cam; in said combing and sorting device, the circular comb has two forms, i.e., full teeth-bar-type needle strip and a teeth-bar-type needle strip combined with a gill bar-type needle strip, so during multiple combing processes, a first combing process employs a full teeth-bar-type needle strip, and following processes of each combing employ a form of the teeth-bar-type needle strip combined with the gill bar-type needle strip, and said top comb has two types, i.e., a single row needle strip type and a multi-row needle strip type, so during the multiple combing processes, the first combing process employs the form of the single row needle strip type, and the following processes of each combing employ the form of the multi-row needle strip type.

* * * * *